US010156813B2

(12) United States Patent
Hashimoto

(10) Patent No.: US 10,156,813 B2
(45) Date of Patent: Dec. 18, 2018

(54) DEVELOPING CARTRIDGE PROVIDED WITH DELAYED TRANSMISSION MECHANISM FOR TRANSMITTING DRIVE FORCE TO FIRST ROTARY BODY AND, AFTER PRESCRIBED TIME, TO SECOND ROTARY BODY

(71) Applicant: Brother Kogyo Kabushiki Kaisha, Nagoya-shi, Aichi-ken (JP)

(72) Inventor: Junichi Hashimoto, Toyohashi (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/469,651

(22) Filed: Mar. 27, 2017

(65) Prior Publication Data

US 2017/0285531 A1 Oct. 5, 2017

(30) Foreign Application Priority Data

Mar. 31, 2016 (JP) ..... 2016-070224

(51) Int. Cl.
*G03G 15/08* (2006.01)

(52) U.S. Cl.
CPC ..... *G03G 15/0896* (2013.01); *G03G 15/0865* (2013.01); *G03G 15/08* (2013.01); *G03G 2215/0177* (2013.01)

(58) Field of Classification Search
CPC ..... G03G 15/0896
USPC ..... 399/119
See application file for complete search history.

(56) References Cited

U.S. PATENT DOCUMENTS

| | | | | |
|---|---|---|---|---|
| 9,213,263 | B2 | 12/2015 | Matsuzaki et al. | |
| 2009/0097884 | A1* | 4/2009 | Kim | G03G 15/0875 399/254 |
| 2013/0308979 | A1 | 11/2013 | Matsuzaki et al. | |
| 2014/0016961 | A1 | 1/2014 | Yasui et al. | |
| 2014/0079432 | A1* | 3/2014 | Matsuzaki | G03G 15/0874 399/106 |

FOREIGN PATENT DOCUMENTS

JP 2013-037345 A 2/2013

* cited by examiner

*Primary Examiner* — Quana M Grainger
(74) *Attorney, Agent, or Firm* — Banner & Witcoff, Ltd.

(57) ABSTRACT

A developing cartridge includes: a casing; a developer container; a developing roller; an unsealing mechanism; a first rotary body; a second rotary body; and a delayed transmission mechanism. The developer container is sealed to accommodate developer. The unsealing mechanism unseals the developer container. The first rotary body is provided at the unsealing mechanism. A drive force from a drive source is transmitted to the first rotary body and the second rotary body. The second rotary body transmits the drive force to the developing roller. The delayed transmission mechanism delays transmission of the drive force to the second rotary body for at least a prescribed time after transmission of the drive force to the first rotary body is initiated. The prescribed time is equivalent to a time that elapses from a moment the unsealing mechanism begins rotating to a moment the unsealing mechanism has unsealed the developer container.

10 Claims, 15 Drawing Sheets

DEVELOPING CARTRIDGE PROVIDED WITH DELAYED TRANSMISSION MECHANISM FOR TRANSMITTING DRIVE FORCE TO FIRST ROTARY BODY AND, AFTER PRESCRIBED TIME, TO SECOND ROTARY BODY

CROSS REFERENCE TO RELATED APPLICATION

This application claims priority from Japanese Patent Application No. 2016-070224 filed Mar. 31, 2016. The entire content of the priority application is incorporated herein by reference.

TECHNICAL FIELD

The present disclosure relates to a developing cartridge including a casing, a developer container disposed in the casing and sealably accommodating developer therein, a developing roller rotatably supported to the casing, and an unsealing mechanism for unsealing the developer container.

BACKGROUND

A conventional developing cartridge known in the art has a casing and a developer container provided in the casing. The developer container accommodates developer and is sealable. The developing cartridge can unseal the developer container when the developing cartridge is used.

SUMMARY

The conventional developing cartridge described above has a sealing member fixed to a rotary member of an agitator that rotates together with a developing roller. An outlet formed in the developer container is sealed by one end portion of the sealing member. When the rotary member rotates, the sealing member is peeled off the developer container, allowing developer in the developer container to be discharged into a developer-accommodating chamber.

However, since a thickness-regulating blade is in contact with a circumferential surface of the developing roller in the conventional developing cartridge, friction produced when the developing roller begins rotating generates great resistance to its rotation. Consequently, when the rotary member of the agitator rotates simultaneously with the developing roller in order to unseal the developer container, excessive load is applied to a motor at startup.

In view of the foregoing, it is an object of the disclosure to provide a developing cartridge that distributes a load applied to a motor at a timing for opening a developing container and a load applied to a motor at a timing for initiating rotation of a developing roller.

In order to attain the above and other objects, the disclosure provides a developing cartridge including: a casing; a developer container; a developing roller; an unsealing mechanism; a first rotary body; a second rotary body; and a delayed transmission mechanism. The developer container is provided in the casing. The developer container is configured to be sealed to accommodate developer. The developing roller is rotatably supported to the casing and has a rotation shaft. The unsealing mechanism is rotatably supported to the casing and has a rotation shaft. The unsealing mechanism is configured to unseal the developer container. The first rotary body is provided at one end portion of the rotation shaft of the unsealing mechanism. A drive force generated by a drive source is transmitted to the first rotary body and the second rotary body. The second rotary body is configured to transmit the drive force from the drive source to the rotation shaft of the developing roller. The delayed transmission mechanism delays transmission of the drive force from the drive source to the second rotary body for at least a prescribed time after transmission of the drive force from the drive source to the first rotary body is initiated. The prescribed time is equivalent to a time that elapses from a moment the unsealing mechanism begins rotating to a moment the unsealing mechanism has unsealed the developer container.

BRIEF DESCRIPTION OF THE DRAWINGS

The particular features and advantages of the embodiment (s) as well as other objects will become apparent from the following description taken in connection with the accompanying drawings, in which:

FIGS. 3A and 3B are explanatory diagrams for explaining how a drive force is transmitted to an agitator and a developing roller provided in the developing cartridge according to the first embodiment, in which:

FIG. 3A is an enlarged cross-sectional view of one end portion of the developing cartridge according to the first embodiment, explaining meshing of a first rotary body disposed at one end portion of the agitator with a second rotary body disposed at one end portion of the developing roller; and FIG. 3B is a view of a second gear and a flange constituting the first rotary body of the agitator provided in the developing cartridge according to the first embodiment, as viewed in a direction indicated by an arrow A;

FIGS. 4A through 4C are explanatory diagrams for explaining operations of the developing cartridge according to the first embodiment, in which:

FIG. 4A is a cross-sectional view of the developing cartridge according to the first embodiment in a state where the developing cartridge is unused;

FIG. 4B is an enlarged cross-sectional view of the one end portion of the developing cartridge according to the first embodiment; and FIG. 4C is a schematic view for explaining meshing of the second gear with a fourth gear provided in the developing cartridge according to the first embodiment;

FIGS. 5A through 5C are explanatory diagrams for explaining the operations of the developing cartridge according to the first embodiment, in which:

FIG. 5A is a cross-sectional view of the developing cartridge according to the first embodiment in a state where a developer container has been unsealed;

FIG. 5B is an enlarged cross-sectional view of the one end portion of the developing cartridge according to the first embodiment; and FIG. 5C is a schematic view for explaining meshing of the second gear with the fourth gear provided in the developing cartridge according to the first embodiment;

FIGS. 6A through 6C are explanatory diagrams for explaining the operations of the developing cartridge according to the first embodiment, in which:

FIG. 6A is a cross-sectional view of the developing cartridge according to the first embodiment in a state where a sealing member rotates together with a blade after the developing container has been unsealed;

FIG. 6B is an enlarged cross-sectional view of the one end portion of the developing cartridge according to the first embodiment; and FIG. 6C is a schematic view for explaining meshing of the second gear with the fourth gear provided in the developing cartridge according to the first embodiment;

FIGS. 9A through 9C are explanatory diagrams for explaining an engaged state of the input-side rotary member and the output-side rotary member of the second rotary body provided in the developing cartridge according to the second embodiment, in which:

FIG. 9A is a schematic view illustrating the engaged state of the input-side rotary member and the output-side rotary member when a drive force is not inputted;

FIG. 9B is a schematic view illustrating the engaged state of the input-side rotary member and the output-side rotary member when a drive force is transmitted only to the input-side rotary member; and FIG. 9C is a schematic view illustrating the engaged state of the input-side rotary member and the output-side rotary member when a drive force is transmitted to both the input-side rotary member and the output-side rotary member;

FIGS. 11A and 11B are explanatory diagrams for explaining operations of the developing cartridge according to the third embodiment, in which:

FIG. 11A is an enlarged cross-sectional view of one end portion of the developing cartridge according to the third embodiment in a state illustrated in FIG. 10A; and FIG. 11B is an enlarged cross-sectional view of the one end portion of the developing cartridge according to the third embodiment in a state illustrated in FIG. 10B;

FIGS. 13A and 13B are explanatory diagrams for explaining operations of the developing cartridge according to the fourth embodiment, in which:

FIG. 13A is an enlarged cross-sectional view of one end portion of the developing cartridge according to the fourth embodiment in a state illustrated in FIG. 12A; and FIG. 13B is a cross-sectional view of a one-way clutch provided in the developing cartridge according to the fourth embodiment in the state illustrated in FIG. 12A;

FIGS. 14A and 14B are explanatory diagrams for explaining the operations of the developing cartridge according to the fourth embodiment, in which:

FIG. 14A is an enlarged cross-sectional view of the one end portion of the developing cartridge according to the fourth embodiment in a state illustrated in FIG. 12B; and FIG. 14B is a cross-sectional view of the one-way clutch provided in the developing cartridge according to the fourth embodiment in the state illustrated in FIG. 12B;

FIGS. 15A and 15B are explanatory diagrams for a developing cartridge according to a first modification that modifies the transmission route of a drive force generated by a drive source to the developing roller via the one-way clutch, in which:

FIG. 15A is an enlarged cross-sectional view of one end portion of the developing cartridge according to the first modification illustrating a state where the developing cartridge is unused and a motor rotates forward; and FIG. 15B is an enlarged cross-sectional view of the one end portion of the developing cartridge according to the first modification illustrating a state where the motor rotates in reverse after a developer container has been unsealed; and FIGS. 16A and 16B are explanatory diagrams for a developing cartridge according to a second modification that modifies the transmission route of a drive force generated by a drive source to the developing roller via the one-way clutch, in which:

FIG. 16A is an enlarged cross-sectional view of one end portion of the developing cartridge according to the second modification illustrating a state where the developing cartridge is unused and a motor rotates forward; and FIG. 16B is an enlarged cross-sectional view of the one end portion of the developing cartridge according to the second modification illustrating a state where the motor rotates in reverse after a developer container has been unsealed.

DETAILED DESCRIPTION

<First Embodiment>

Figure 1:
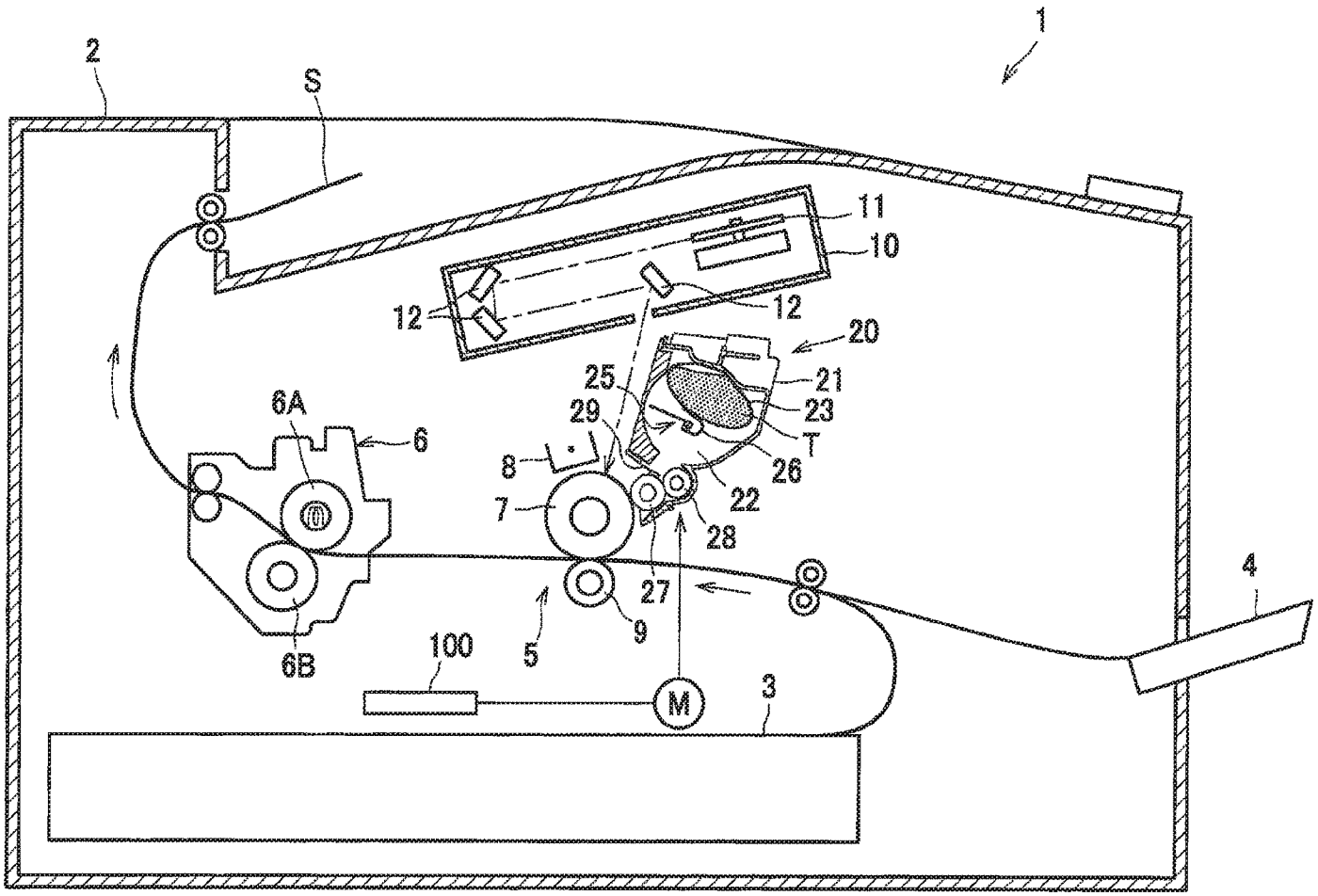
FIG. 1 is a schematic cross-sectional view of a laser printer.

A developing cartridge 20 according to a first embodiment will be described with reference to FIGS. 1 through 6C, wherein like parts and components are designated by the same reference numerals to avoid duplicating description.

First, an overall structure of a laser printer 1 as an image forming apparatus in which the developing cartridge 20 is used will be described with reference to FIG. 1.

The laser printer 1 is adapted to form images on sheets S. The laser printer 1 includes a main casing 2 within which are provided a sheet feeding tray 3, a manual tray 4, a process unit 5, a fixing unit 6, and a control device 100.

The process unit 5 is a component of the laser printer 1 that forms developer images on sheets S. The process unit 5 includes a photosensitive drum 7, a charger 8, a transfer roller 9, a scanner 10, and the developing cartridge 20.

The scanner 10 is disposed in an upper portion of the main casing 2. The scanner 10 includes a laser-emitting unit (not illustrated), a polygon mirror 11, a plurality of reflection mirrors 12, and a plurality of lenses (not illustrated). The laser-emitting unit of the scanner 10 emits a laser beam that is reflected off the polygon mirror 11 and the reflection mirrors 12 and passes through the lenses to be scanned over a surface of the photosensitive drum 7, as illustrated by a chain line in FIG. 1.

The developing cartridge 20 is provided with a casing 21, a developer-accommodating chamber 22 formed inside the casing 21, and a gear cover 70. Further, the developing cartridge 20 is further provided with a developer container 23, an agitator 25, a sealing member 26, a developing roller 27, a supply roller 28, and a thickness-regulating blade 29. The developer container 23 is disposed in the developer-accommodating chamber 22 and accommodates toner T as an example of a developer. The agitator 25 is an example of an agitating member. The sealing member 26 functions to seal the developer container 23. The supply roller 28 is adapted to supply toner T onto the developing roller 27.

The agitator 25, the developing roller 27, and the supply roller 28 are rotatably supported to the casing 21.

The developing roller 27 is disposed in confrontation with the photosensitive drum 7. The toner T in the developer-accommodating chamber 22 is supplied to the developing roller 27 by rotation of the supply roller 28. Toner T supplied to the developing roller 27 is carried on a surface of the developing roller 27.

The charger 8 is disposed above the photosensitive drum 7 and is separated from the photosensitive drum 7. The transfer roller 9 is disposed beneath the photosensitive drum 7 and in confrontation with the photosensitive drum 7.

While the photosensitive drum 7 rotates, the charger 8 applies a charge of positive polarity, for example, to the surface of the photosensitive drum 7. The surface of the photosensitive drum 7 is exposed to a laser beam emitted by the scanner 10. The laser beam forms an electrostatic latent image on the surface of the photosensitive drum 7. Thereafter, the developing roller 27 supplies toner T to the electrostatic latent image on the photosensitive drum 7, forming a developer image on the surface of the photosensitive drum 7. The developer image on the photosensitive drum 7 is subsequently transferred onto a sheet S by a transfer bias applied to the transfer roller 9 as the sheet S is passing between the photosensitive drum 7 and the transfer roller 9.

The fixing unit 6 is disposed downstream relative to the process unit 5 in a conveying direction of the sheet S. The fixing unit 6 is provided with a fixing roller 6A, and a pressure roller 6B that applies pressure to the fixing roller 6A. The fixing roller 6A is configured of a cylindrical roller, and a heater disposed inside the cylindrical roller. The fixing unit 6 is adapted to fix the developer image to the sheet S by applying heat to the sheet S with the heater in the fixing roller 6A while the sheet S is nipped and conveyed between the fixing roller 6A and the pressure roller 6B.

The control device 100 includes a CPU, a ROM, a RAM, and the like (not illustrated). The control device 100 is configured to receive print data, to feed sheets S from the sheet feeding tray 3 and the manual tray 4, and to control the process unit 5, the fixing unit 6, and the like based on pre-stored programs.

Next, the developing cartridge 20 will be described in detail.

Figure 2:
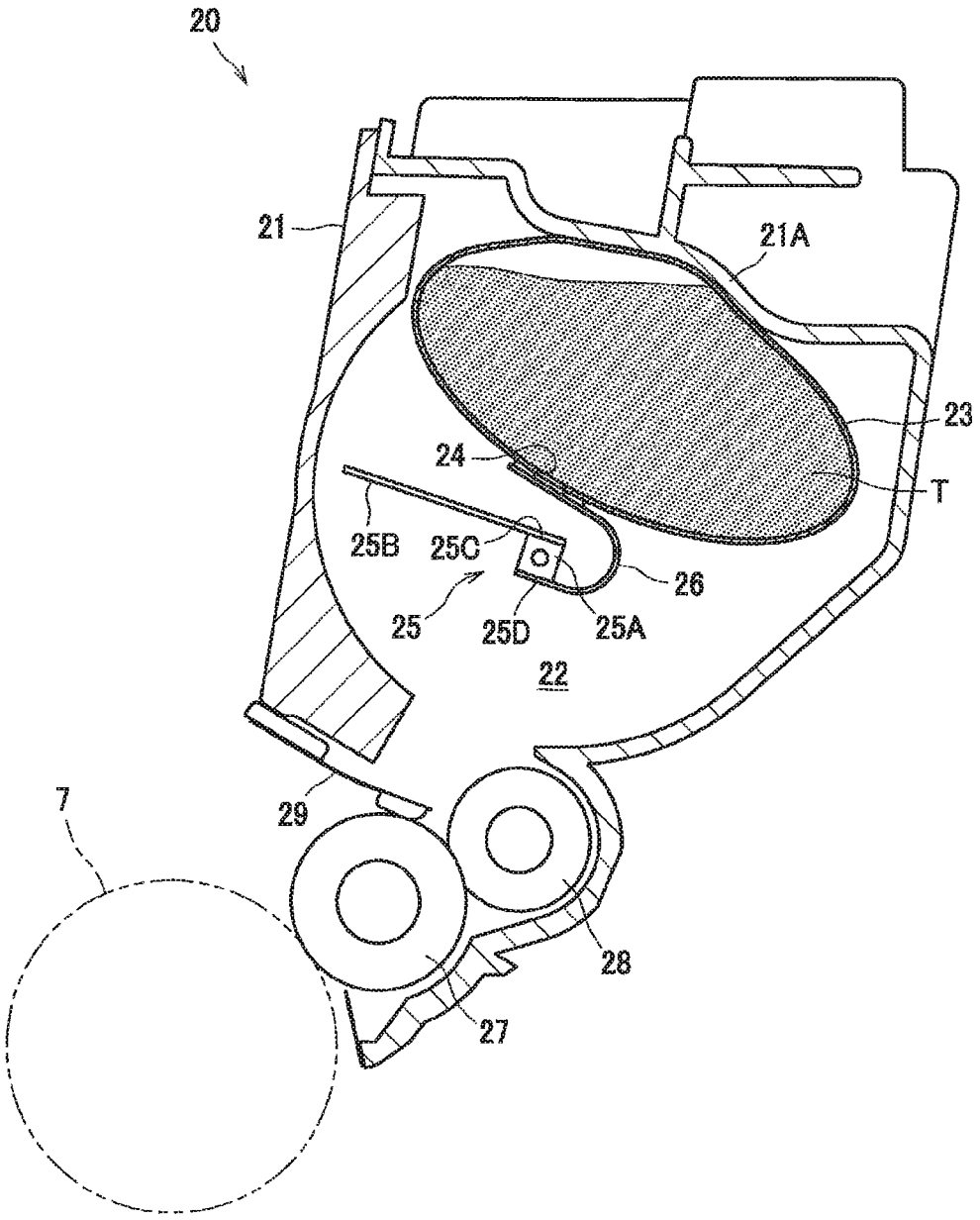
FIG. 2 is an enlarged cross-sectional view of a developing cartridge according to a first embodiment that is mounted in the laser printer.

As illustrated in FIG. 2, the developer container 23 is a bag-like container formed of a material that is more easily deformed than a material for forming the casing 21. The developer container 23 is adapted to be sealed and to accommodate the toner T therein. An outlet 24 is formed in a bottom portion of the developer container 23 to allow discharge of the toner T into the developer-accommodating chamber 22. The developer container 23 is fixed to a top wall 21A of the casing 21.

The developer container 23 may be formed of any material. The developer container 23 may be formed of polyethylene terephthalate (PET), polyethylene (PE), or polypropylene (PP), for example. The material for forming the developer container 23 is not particularly limited to these materials.

The agitator 25 is disposed below the developer container 23. The agitator 25 is adapted to agitate the toner T within the developer-accommodating chamber 22. The agitator 25 constitutes an unsealing mechanism together with the sealing member 26. The agitator 25 includes a rotary member 25A, and a blade 25B. One end portion of the blade 25B is fixed to the rotary member 25A so that the blade 25B rotates together with the rotary member 25A. The rotary member 25A has a first fixing surface 25C to which the blade 25B is fixed, and a second fixing surface 25D on the opposite side of the first fixing surface 25C to which the sheet-like sealing member 26 is fixed. One end portion of the sealing member 26 is fixed to the rotary member 25A, while the other end portion is releasably bonded to a peripheral surface around the outlet 24 formed in the developer container 23.

The sealing member 26 is formed of polyethylene terephthalate (PET), polyethylene (PE), or polypropylene (PP), for example.

The developing cartridge 20 is configured such that the rotary member 25A of the agitator 25 starts rotating first, and, after a prescribed time required for unsealing the developer container 23 has elapsed, the developing roller 27 subsequently starts rotating.

Next, a delayed transmission mechanism for rotating the developing roller 27 after a period at least equivalent to the prescribed time has elapsed will be described with reference to FIGS. 3A through 6C.

Figure 3A:
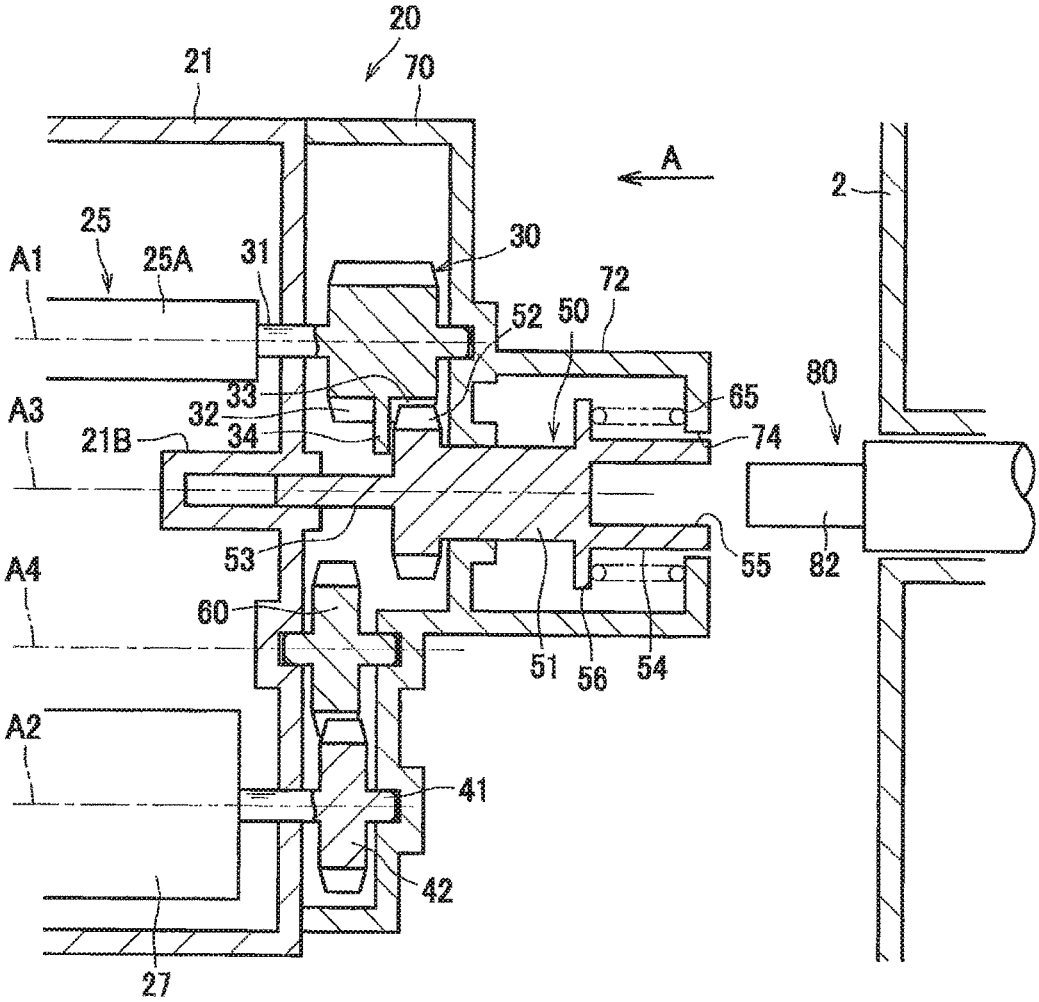

As illustrated in FIG. 3A, the rotary member 25A of the agitator 25 has a shaft 31. The shaft 31 is rotatably supported to the casing 21 and is capable of rotating about a first axis A1. One end portion of the shaft 31 protrudes to an outer side of the casing 21 and is rotatably supported to the gear cover 70. A first rotary body 30 is provided at the one end portion of the shaft 31 protruding to the outer side of the casing 21. The first rotary body 30 includes a first gear 32, a second gear 33, and a flange 34. The flange 34 is integrally formed with the first gear 32 and the second gear 33.

Specifically, the first gear 32 is a gear capable of rotating about the first axis A1 at a position outside the casing 21. The second gear 33 is a gear capable of rotating coaxially with the first gear 32 and is disposed at an outer side relative to the first gear 32 in a first axial direction along the first axis A1. The first gear 32 and the second gear 33 have the same module and addendum circles with the same diameter. Gear teeth of the first gear 32 and gear teeth of the second gear 33 are provided at the same positions in their rotating direction. The flange 34 is disposed between the first gear 32 and the second gear 33. The flange 34 has a greater diameter than that of the addendum circles of the first gear 32 and the second gear 33.

Figure 3B:
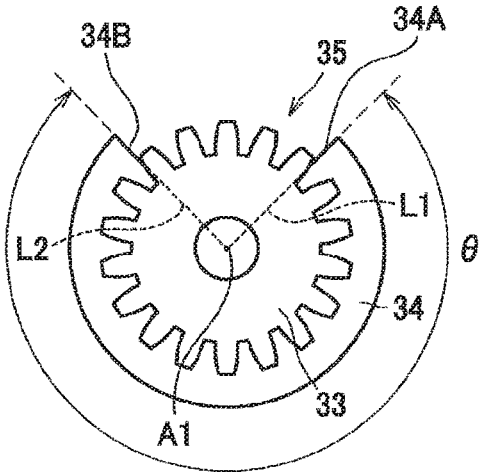

As illustrated in FIG. 3B, a notch 35 is formed in a portion of the flange 34. The first gear 32 and the second gear 33 are connected to each other through the flange 34. The size of the notch 35 is set to correspond to a time that elapses from a moment rotation of the rotary member 25A is initiated to a moment the sealing member 26 is peeled off the developer container 23 (i.e. the prescribed time). Preferably, the prescribed time is equivalent to a time that elapses from a moment the sealing member 26 begins to be peeled off the developer container 23 after the rotary member 25A begins to rotate to a moment the toner accommodated in the developer container 23 begins to be discharged into the developer-accommodating chamber 22. More preferably, the prescribed time is equivalent to a time that elapses from a moment rotation of the rotary member 25A is initiated to a moment the sealing member 26 has been completely peeled off the developer container 23. An angle θ in a rotating direction of the flange 34 (a second angle), is set in a range from 90 degrees to 315 degrees, and more preferably, in a range from 180 degrees to 270 degrees. Note that the angle θ is the central angle of the flange 34. More specifically, the flange 34 has a first edge 34A and a second edge 34B opposite to the first edge 34A in the rotating direction of the flange 34. The first edge 34A and the second edge 34B define the notch 35. The angle θ is an angle formed by a first line segment L1 connecting the first axis A1 and the first edge 34A and a second line segment L2 connecting the first axis A1 and the second edge 34B.

As illustrated in FIG. 3A, the developing roller 27 has a shaft 41. The shaft 41 is rotatably supported to the casing 21 and is capable of rotating about a second axis A2 parallel to the first axis A1.

One end portion of the shaft 41 protrudes to the outer side of the casing 21 and is rotatably supported to the gear cover 70. A third gear 42 as a second rotary body is provided at the one end portion of the shaft 41 protruding to the outer side of the casing 21.

The casing 21 and the gear cover 70 also rotatably support a drive gear 50 and an intermediate gear 60. The drive gear 50 and the intermediate gear 60 are disposed between the first rotary body 30 of the agitator 25 and the third gear 42 of the developing roller 27. The drive gear 50 is an example of a transmission rotary body and an example of a transmission gear. The drive gear 50 is adapted to transmit a drive force generated by a motor M provided in the main casing 2 to the first rotary body 30 and to the third gear 42 via the intermediate gear 60. The intermediate gear 60 is adapted to transmit a drive force transmitted from the drive gear 50 to the third gear 42.

The drive gear 50 has a body portion 51, a fourth gear 52, a protruding portion 53, and an outer end portion 54. The body portion 51 is rotatably supported to the gear cover 70 and is capable of rotating about a third axis A3 parallel to the first axis A1 and the second axis A2. The fourth gear 52 is provided at the body portion 51 and meshes with the second gear 33 of the agitator 25 in an initial state. The protruding portion 53 protrudes toward the casing 21 from the body portion 51. The protruding portion 53 is supported in a bearing portion 21B of the casing 21 so as to be capable of slidably moving and rotating relative to the bearing portion 21B. The outer end portion 54 is disposed opposite to the protruding portion 53 with respect to the body portion 51. The outer end portion 54 has a coupling groove 55 and a flange portion 56. The coupling groove 55 is engageable with an engaging protrusion 82 of a coupling 80 provided in the main casing 2 of the laser printer 1.

The drive gear 50 is supported to the gear cover 70 such that the coupling groove 55 is exposed to an outside of the gear cover 70 through an opening 74 formed in a protruding portion 72 of the gear cover 70. A spring 65 as an example of an urging member is disposed around the outer end portion 54 at a position between the flange part 56 and the protruding portion 72 of the gear cover 70 (i.e. a wall of the protruding portion 72 in which the opening 74 is formed). The spring 65 urges the drive gear 50 toward the casing 21, i.e., inward in the first axial direction.

The intermediate gear 60 is capable of rotating about a fourth axis A4 parallel to the first axis A1, the second axis A2, and the third axis A3. The intermediate gear 60 meshes with the third gear 42 of the developing roller 27. As will be described later, the intermediate gear 60 is adapted to transmit a drive force received from the coupling 80 via the drive gear 50 to the developing roller 27 when the intermediate gear 60 becomes engaged with the fourth gear 52 of the drive gear 50.

In the first embodiment, the delayed transmission mechanism is configured by the drive gear 50, the first rotary body 30 of the agitator 25, the third gear 42 (second rotary body) of the developing roller 27, and the spring 65.

Next, operations of the developing cartridge 20 will be described with reference to FIGS. 4A through 6C.

Figure 4A:
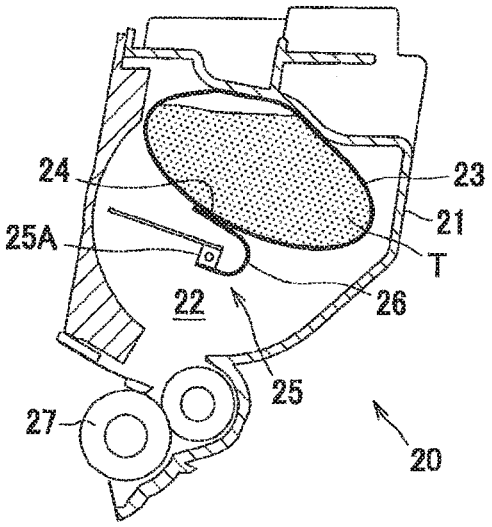
Figure 4C:
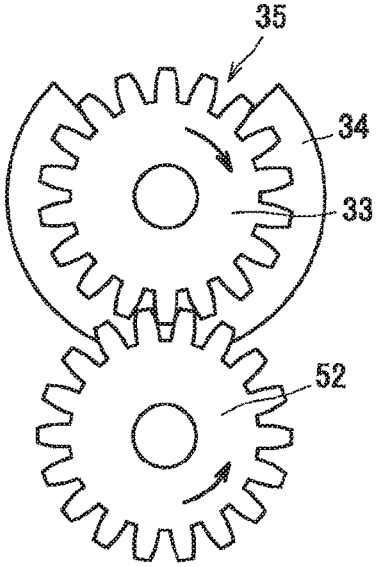
Figure 4B:
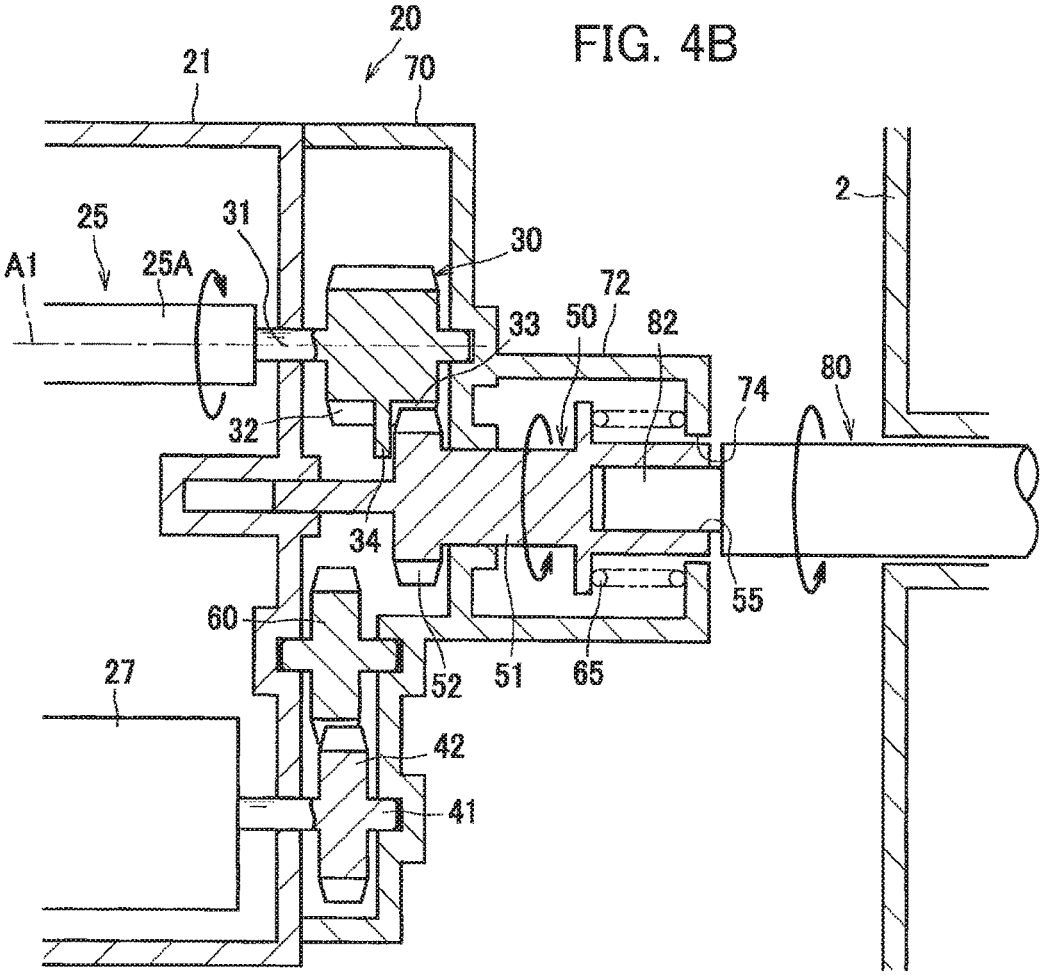

First, when an unused developing cartridge 20 is mounted in the main casing 2 of the laser printer 1, the coupling 80 provided in the main casing 2 moves from a position illustrated in FIG. 3A to a position illustrated in FIG. 4B. The engaging protrusion 82 of the coupling 80 passes through the opening 74 formed in the gear cover 70 of the developing cartridge 20 and becomes engaged with the coupling groove 55 of the drive gear 50. At this time, a drive force generated by the motor M provided in the main casing 2 of the laser printer 1 is transmitted to the second gear 33 of the agitator 25 via the coupling 80 and the drive gear 50, and the second gear 33 begins to rotate. The motor M is an example of a drive source.

As illustrated in FIG. 4B, the spring 65 urges the drive gear 50 inward in the first axial direction. However, since the fourth gear 52 contacts the flange 34 as illustrated in FIG. 4C, the fourth gear 52 is meshed with the second gear 33 and not meshed with the first gear 32. The position of the drive gear 50 illustrated in FIG. 4B is an example of a first position.

Further, since the fourth gear 52 and the intermediate gear 60 are not meshed with each other at this time, the drive force is not transmitted to the third gear 42 of the developing roller 27. That is, the drive gear 50 is in meshing with the first rotary body 30 but out of meshing with the third gear 42 when the drive gear 50 is at the first position. Consequently, the developing roller 27 remains idle, that is, the developing roller 27 does not rotate. Further, the sealing member 26 maintains a seal over the outlet 24 formed in the developer container 23. However, the rotation of the second gear 33 rotates the rotary member 25A of the agitator 25. As a result, the sealing member 26 begins moving in a direction for wrapping around the rotary member 25A.

Figure 5A:
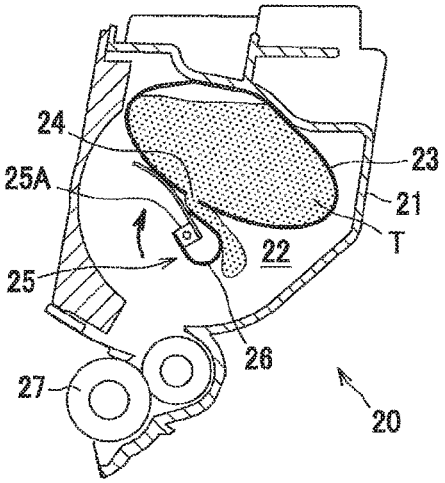
Figure 5C:
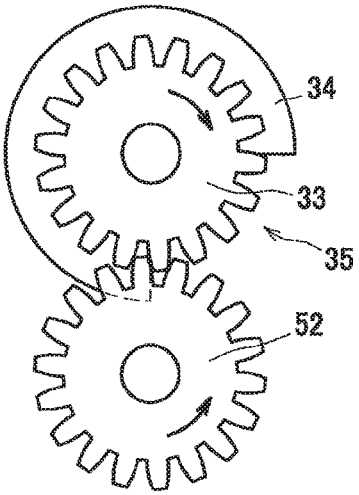
Figure 5B:
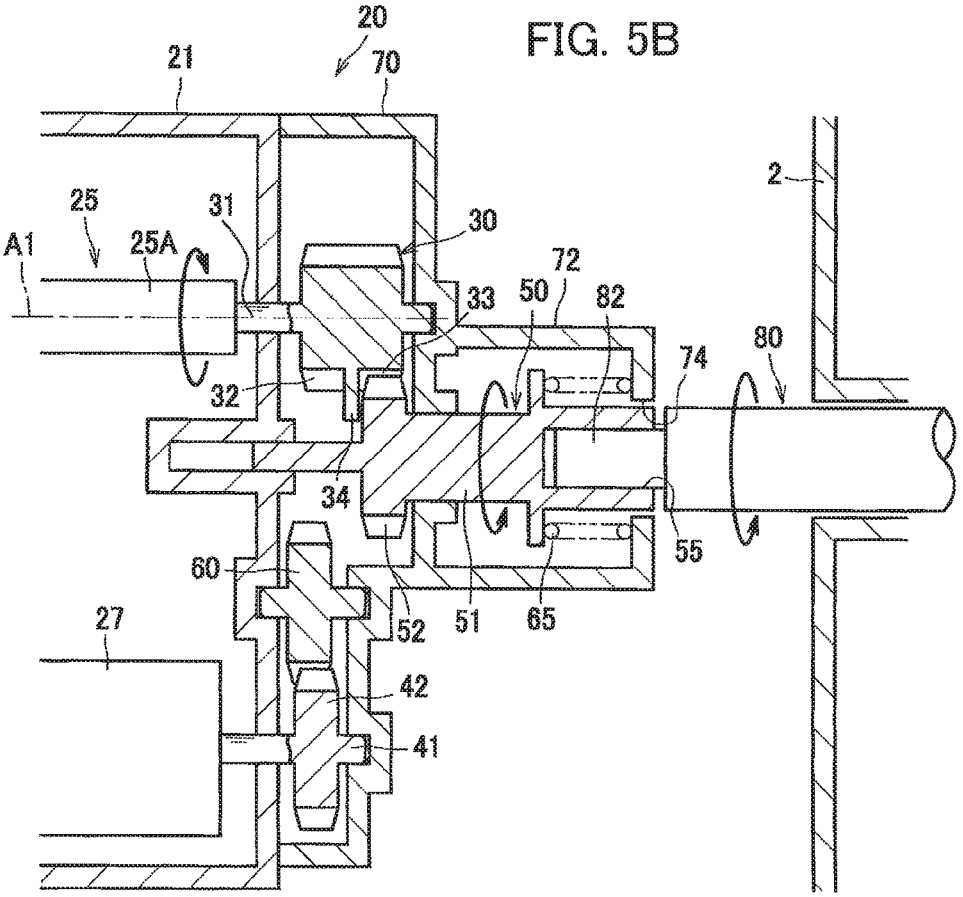

As the fourth gear 52 and the second gear 33 continue to rotate, the rotary member 25A is further rotated by the rotation of the second gear 33, as illustrated in FIGS. 5A through 5C. As illustrated in FIG. 5A, the sealing member 26 is pulled away from the developer container 23 and becomes wound about the rotary member 25A. In other words, the sealing member 26 is peeled off the developer container 23, thereby opening the outlet 24 formed in the developer container 23 and allowing toner accommodated in the developer container 23 to be discharged into the developer-accommodating chamber 22.

As illustrated in FIG. 5B, the spring 65 continues to urge the drive gear 50 inward in the first axial direction. However, since the fourth gear 52 is still in contact with the flange 34 as illustrated in FIG. 5C, the fourth gear 52 remains meshed with the second gear 33 and is not meshed with the first gear 32.

Since the fourth gear 52 is not meshed with the intermediate gear 60 at this time, the drive force is not transmitted to the third gear 42 of the developing roller 27. Accordingly, the developing roller 27 remains idle. That is, the developing roller 27 has not yet rotated.

Figure 6A:
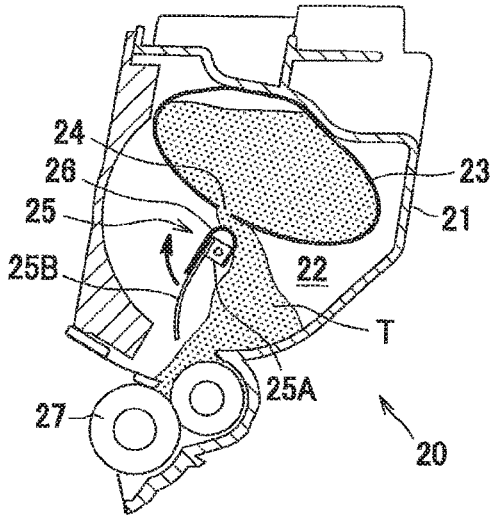
Figure 6C:
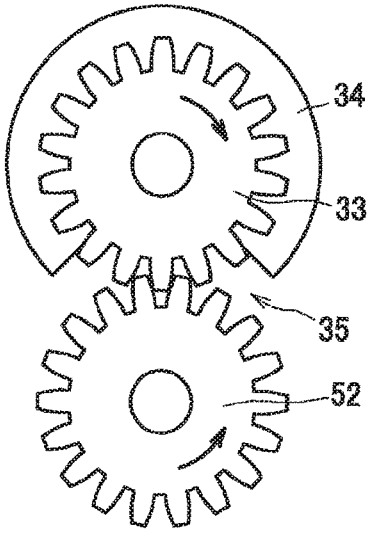
Figure 6B:
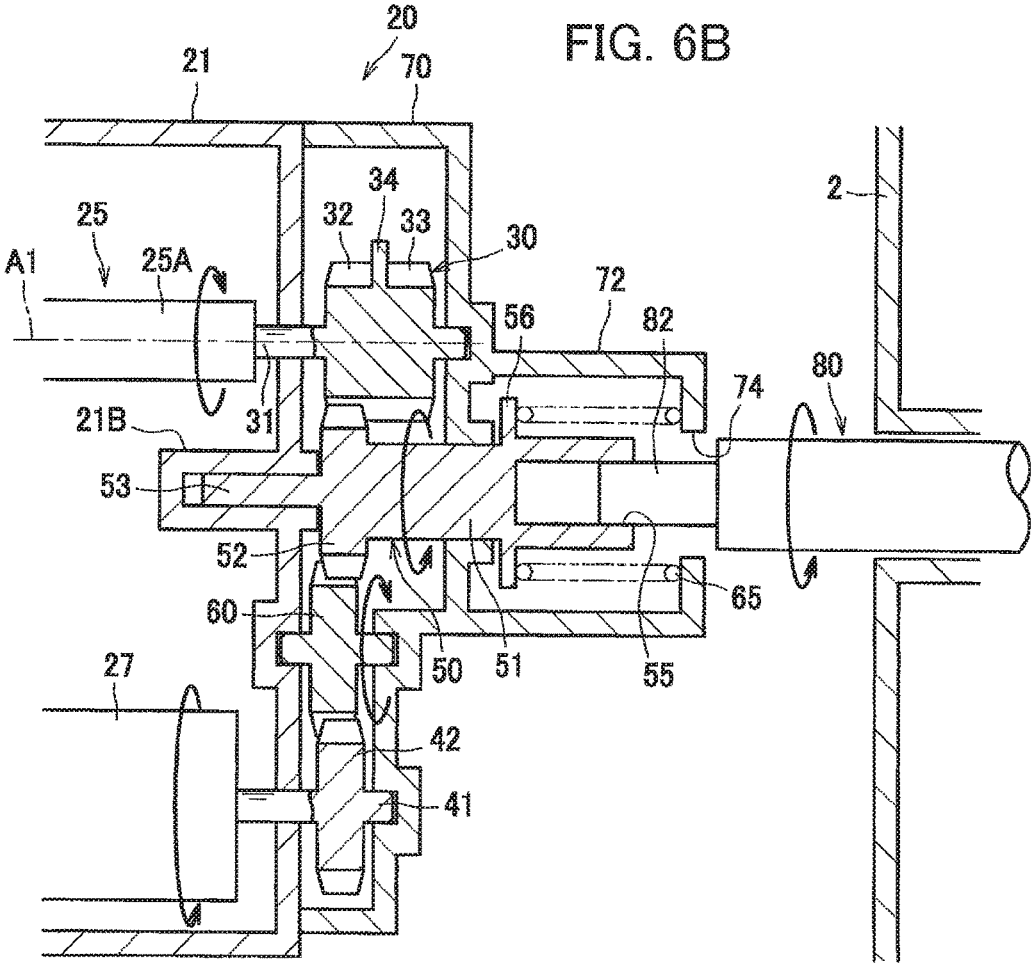

As the fourth gear 52 and the second gear 33 continue to rotate, as illustrated in FIGS. 6A through 6C, the notch 35 of the flange 34 moves to a position opposite to the fourth gear 52, as illustrated in FIG. 6C. At this time, the fourth gear 52 no longer contacts the flange 34, and the urging force of the spring 65 moves the fourth gear 52 inward in the first axial direction through the notch 35, as illustrated in FIG. 6B. This action meshes the fourth gear 52 with the first gear 32 of the agitator 25, and simultaneously meshes the fourth gear 52 with the third gear 42 of the developing roller 27 via the intermediate gear 60. The position of the drive gear 50 illustrated in FIG. 6B is an example of a second position. That is, the drive gear 50 is in meshing with both the first rotary body 30 and the third gear 42 when the drive gear 50 is at the second position.

At the same time, the protruding portion 53 of the drive gear 50 moves farther into the bearing portion 21B of the casing 21, and the body portion 51 moves farther into the protruding portion 72 of the gear cover 70, while the engaging protrusion 82 of the coupling 80 remains engaged with the coupling groove 55.

Here, the agitator 25 continues to rotate through the meshing of the fourth gear 52 and the first gear 32.

When the fourth gear 52 meshes with the intermediate gear 60, the drive force from the motor M is transmitted to the third gear 42 of the developing roller 27 via the intermediate gear 60, and the developing roller 27 begins to rotate. Thereafter, the agitator 25 and the developing roller 27 rotate together while the fourth gear 52 remains meshed with the first gear 32 and the third gear 42.

As illustrated in FIG. 6A, the sealing member 26 peeled off the developer container 23 is wrapped around the rotary member 25A and rotates together with the blade 25B.

In this way, the drive gear 50 initiates transmission of the drive force generated by the motor M to the third gear 42 when the prescribed time has elapsed after the drive gear 50 initiates transmission of the drive force from the motor M to the first rotary body 30. In other words, movement of the drive gear 50 from the first position to the second position requires the prescribed time.

The prescribed time is required for the sealing member 26 to be peeled off the developer container 23 after the second gear 33 becomes meshed with the fourth gear 52 and begins to rotate. If an angle that the second gear 33 rotates in the prescribed time is called a first angle, the angle θ (the second angle) in the rotating direction of the flange 34 is set greater than the first angle.

Hence, rotation of the developing roller 27 is begun once the prescribed time has elapsed after starting rotation of the agitator 25 to ensure that the sealing member 26 has been peeled off the developer container 23.

With the developing cartridge 20 having the above configuration, the load applied to the motor M when unsealing the developer container 23 and the load applied to the motor M when initiating rotation of the developing roller 27 can be staggered, thereby preventing the entire load from being applied to the motor M simultaneously. This configuration can ensure stable operation of the developing cartridge 20.

In the embodiment described above, the first gear 32, the second gear 33, and the flange 34 of the agitator 25 are formed integrally with each other. However, this structure may be modified as desired, provided that the fourth gear 52 is not prevented from moving smoothly inward in the first axial direction. For example, the first gear may be provided separately from an integrally formed second gear and flange.

Further, while the fourth gear 52 of the drive gear 50 is meshed with the third gear 42 of the developing roller 27 indirectly through the intermediate gear 60 in the embodiment described above, the intermediate gear 60 may be omitted and the fourth gear 52 and the third gear 42 may be configured to mesh directly with each other.

<Second Embodiment>

Next, a developing cartridge 120 according to a second embodiment will be described with reference to FIGS. 7 through 9C, wherein like parts and components to those in the first embodiment are designated with the same reference numerals to avoid duplicating description.

As in the developing cartridge 20 of the first embodiment, the developing cartridge 120 according to the second embodiment has the unsealing mechanism configured of the agitator 25 and the sealing member 26, whereby the sealing member 26 sealing the outlet 24 formed in the developer container 23 is peeled off the developer container 23 when the agitator 25 rotates.

Note that the developer container 23 and the sealing member 26 have been omitted from FIGS. 7 through 9C.

Figure 7:
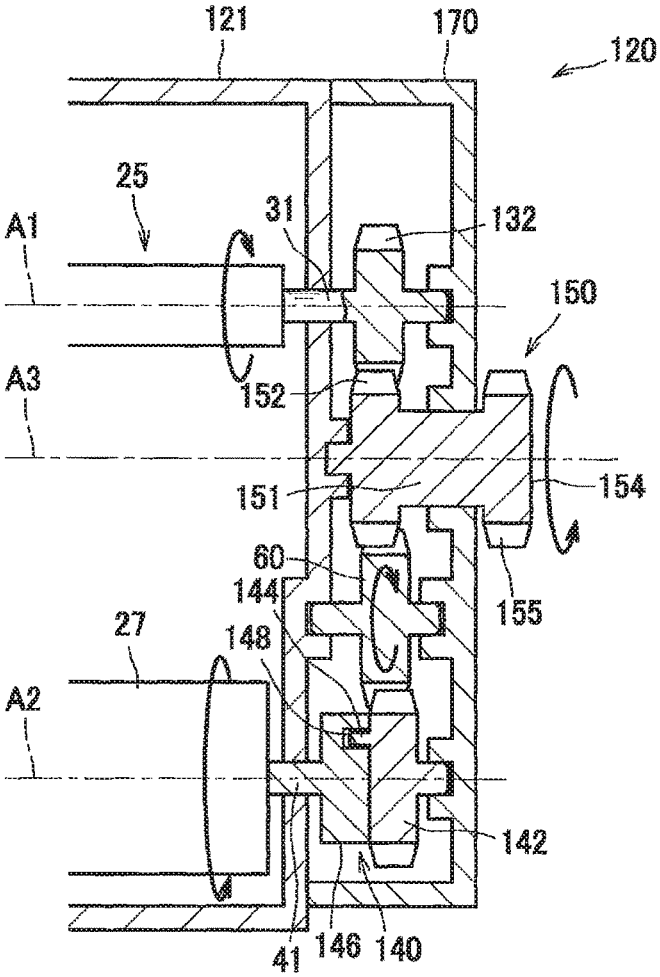
FIG. 7 is an enlarged cross-sectional view of one end portion of a developing cartridge according to a second embodiment, explaining meshing of a first rotary body disposed at one end portion of an agitator with a second rotary body disposed at one end portion of a developing roller.

As illustrated in FIG. 7, the developing cartridge 120 is provided with a casing 121, and a gear cover 170. The one end portion of the shaft 31 of the agitator 25 and the one end portion of the shaft 41 of the developing roller 27 protrude to an outer side of the casing 121 and are rotatably supported to the gear cover 170.

A first gear 132 serving as the first rotary body is provided at the one end portion of the shaft 31 of the agitator 25 protruding to the outer side of the casing 121.

A second rotary body 140 is provided at the one end portion of the shaft 41 of the developing roller 27 protruding to the outer side of the casing 121.

The second rotary body 140 has an input-side rotary member 142, and an output-side rotary member 146 capable of rotating coaxially with the input-side rotary member 142.

Figure 8:
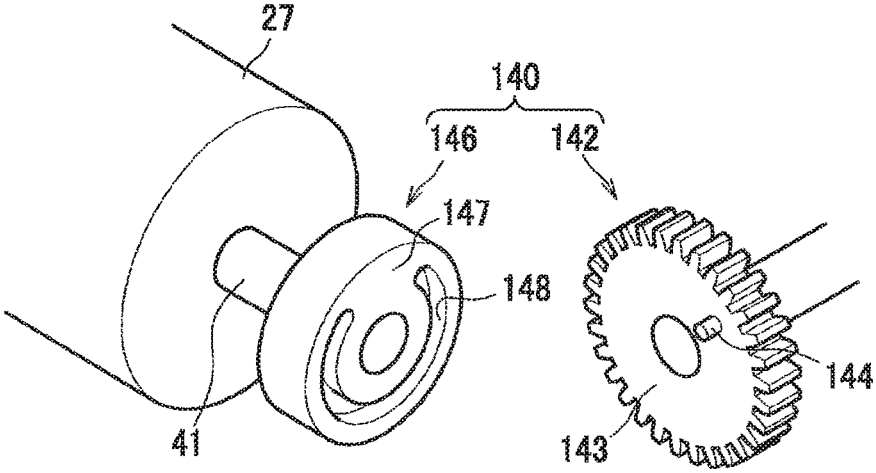
FIG. 8 is a perspective view illustrating an input-side rotary member and an output-side rotary member of the second rotary body provided in the developing cartridge according to the second embodiment.

As illustrated in FIGS. 7 and 8, the input-side rotary member 142 is a gear capable of rotating about the second axis A2 (a rotational axis). The input-side rotary member 142 has an endface 143 that confronts the output-side rotary member 146. An engaging protrusion 144 is provided on the endface 143.

The output-side rotary member 146 is capable of rotating about the second axis A2 (the rotational axis). The output-side rotary member 146 has an endface 147 that confronts the input-side rotary member 142. An engaging groove 148 is formed in the endface 147. The engaging groove 148 extends in an arcuate shape centered on the second axis A2.

When the input-side rotary member 142 and the output-side rotary member 146 are assembled to each other, the engaging protrusion 144 on the input-side rotary member 142 is engaged with the engaging groove 148 formed in the output-side rotary member 146. The input-side rotary member 142 can rotate freely relative to the output-side rotary member 146 within a range that the engaging protrusion 144 can move within the engaging groove 148, during which time the input-side rotary member 142 does not transmit the drive force to the output-side rotary member 146.

A length of the engaging groove 148 in a circumferential direction of the output-side rotary member 146 (an angle in the circumferential direction) is set to correspond to a length of time (the prescribed time) that elapses from a moment rotation of the agitator 25 is initiated to a moment the developer container 23 is unsealed.

As illustrated in FIG. 7, the casing 121 and the gear cover 170 rotatably support a drive gear 150, and the intermediate gear 60. The drive gear 150 and the intermediate gear 60 are disposed between the first gear 132 of the agitator 25 and the second rotary body 140 of the developing roller 27. The intermediate gear 60 is adapted to transmit a drive force from the drive gear 150 to the second rotary body 140.

The drive gear 150 has a gear body 151, a fourth gear 152, an input gear 155, and an outer end portion 154. The gear body 151 is rotatably supported to the gear cover 170 and is capable of rotating about the third axis A3 (the rotational axis) parallel to the first axis A1 of the agitator 25 and the second axis A2 of the developing roller 27. The fourth gear 152 is provided at the gear body 151 and meshes with the first gear 132 of the agitator 25 and the intermediate gear 60. The outer end portion 154 protrudes to an outer side of the gear cover 170. The input gear 155 is provided at an outer end portion 154.

In the developing cartridge 120 of the second embodiment having the above configuration, the delayed transmission mechanism is configured by the input-side rotary member 142 and the output-side rotary member 146 provided at the one end portion of the shaft 41 of the developing roller 27 protruding to the outer side of the casing 121. The drive force transmitted to the input-side rotary member 142 is subsequently transmitted to the output-side rotary member 146 after the engaging protrusion 144 has rotated a prescribed amount relative to the engaging groove 148.

Next, operations of the developing cartridge 120 will be described with reference to FIGS. 7 and 9C.

Figure 9A:
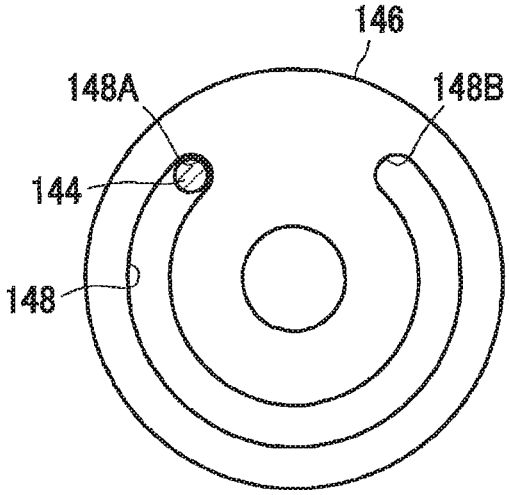

When an unused developing cartridge 120 is mounted in the main casing 2 of the laser printer 1, the engaging protrusion 144 of the input-side rotary member 142 is positioned at an upstream end 148A of the engaging groove 148 in a rotating direction of the output-side rotary member 146, as illustrated in FIG. 9A.

When a drive force from the motor M serving as the drive source is inputted into the drive gear 150 via the input gear 155, the drive force is transmitted to the first gear 132 and the intermediate gear 60 via the fourth gear 152. As a result, the first gear 132 and the intermediate gear 60 begin to rotate.

Figure 9B:
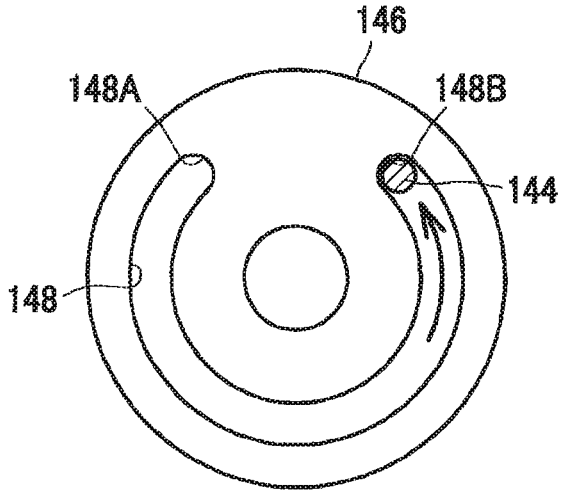

Subsequently, the developer container 23 is unsealed as the agitator 25 rotates together with the first gear 132. At the same time, the input-side rotary member 142 meshed with the intermediate gear 60 rotates, but the engaging protrusion 144 of the input-side rotary member 142 moves along the engaging groove 148, as illustrated in FIG. 9B. Hence, the input-side rotary member 142 rotates freely relative to the output-side rotary member 146. Thus, the developing roller 27 does not rotate. Accordingly, the developing roller 27 remains idle (i.e. does not rotate) while the developer container 23 is being unsealed.

As the input-side rotary member 142 continues to rotate, the engaging protrusion 144 arrives at a downstream end 148B of the engaging groove 148 in the rotating direction and contacts the downstream end 148B of the engaging groove 148, as illustrated in FIG. 9B.

Figure 9C:
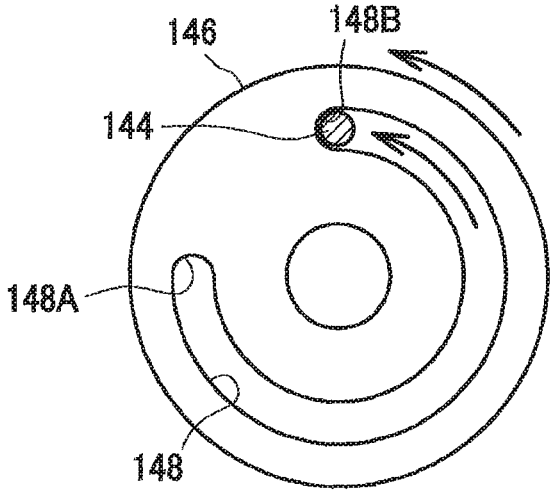

Thereafter, the input-side rotary member 142 and the output-side rotary member 146 rotate together while the engaging protrusion 144 remains in contact with the downstream end 148B of the engaging groove 148, as illustrated in FIG. 9C. Consequently, the agitator 25 and the developing roller 27 rotate together.

With the developing cartridge 120 of the second embodiment having the above configuration, the load applied to the motor M when unsealing the developer container 23 and the load applied to the motor M when initiating rotation of the developing roller 27 can be staggered, thereby preventing the entire load from being applied to the motor M simultaneously. This configuration can ensure stable operation of the developing cartridge 120.

In the developing cartridge 120 according to the second embodiment, the engaging protrusion 144 is provided on the endface 143 of the input-side rotary member 142, and the arcuate-shaped engaging groove 148 is formed in the endface 147 of the output-side rotary member 146. However, an engaging groove may be formed in the input-side rotary member while an engaging protrusion may be provided at the output-side rotary member instead.

Further, the unsealing mechanism is configured so that the sealing member 26 is peeled off the developer container 23 as the rotary member 25A of the agitator 25 rotates. However, the sealing member may be omitted, and the developer container may be unsealed by a rotating blade fixed to the rotary member 25A of the agitator 25, for example.

<Third Embodiment>

Next, a developing cartridge 220 according to a third embodiment will be described with reference to FIGS. 10A through 11B, wherein like parts and components with those of the developing cartridge 120 according to the second embodiment are designated with the same reference numerals to avoid duplicating description.

The developing cartridge 220 according to the third embodiment is provided with a configuration for taking up a developer container 223 after the developer container 223 has been unsealed.

Figure 10B:
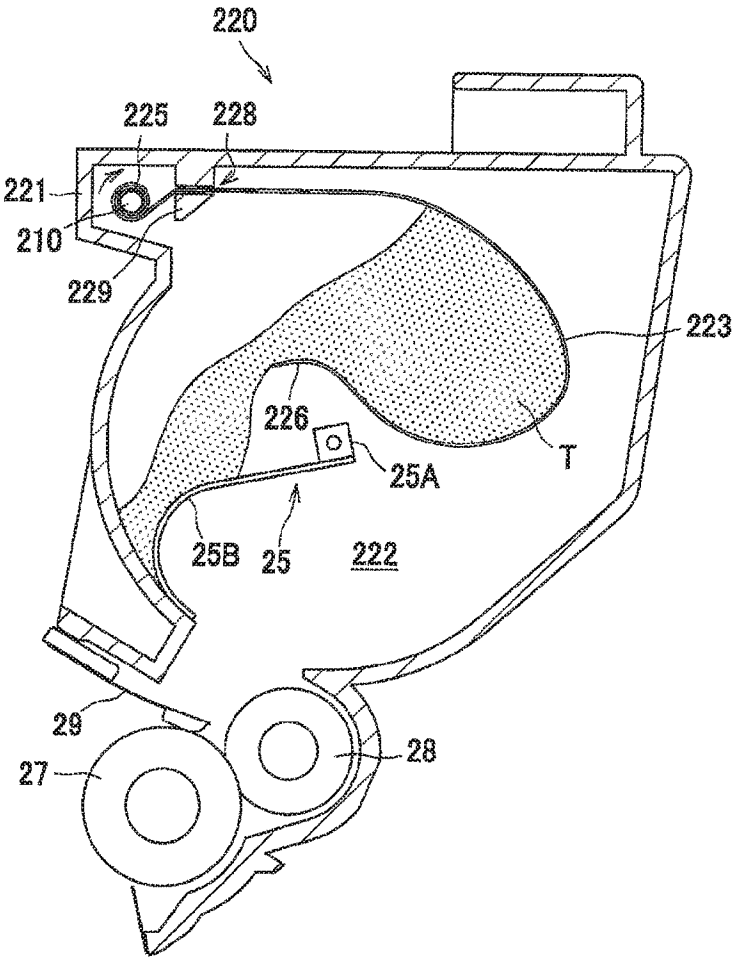
FIG. 10B is a cross-sectional view of the developing cartridge according to the third embodiment in a state where a developer container provided in the developing cartridge has been unsealed.
Figure 10A:
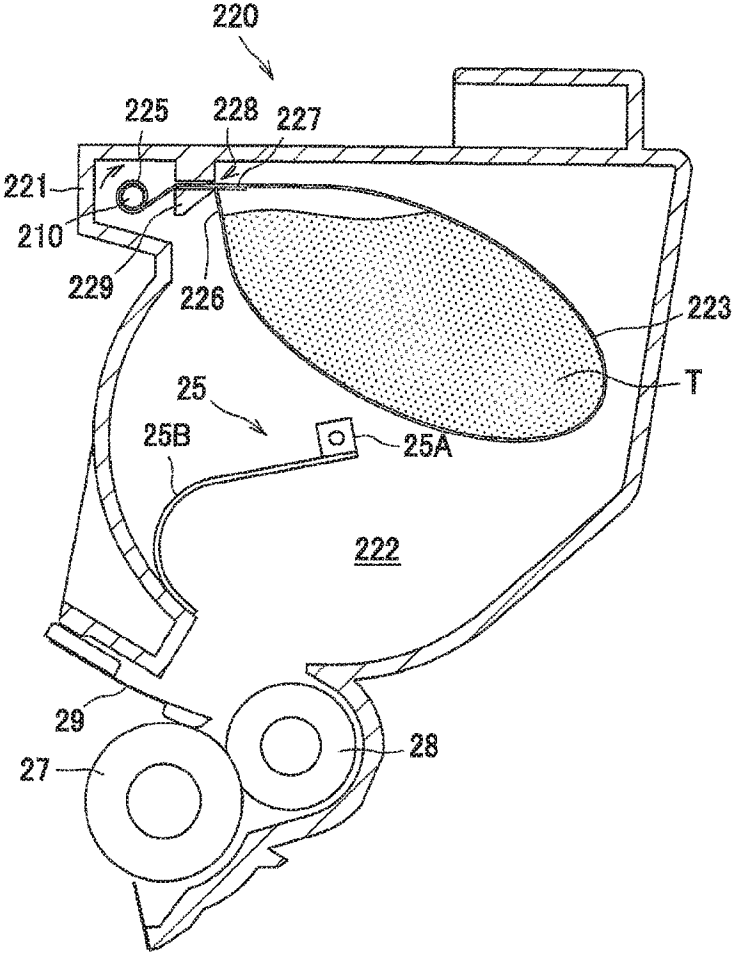
FIG. 10A is a cross-sectional view of a developing cartridge according to a third embodiment in a state where the developing cartridge is unused.

As illustrated in FIG. 10A, the developing cartridge 220 is provided with a casing 221, and a developer-accommodating chamber 222 formed inside the casing 221. The developing cartridge 220 is further provided with a developer container 223, a take-up member 210, the agitator 25, the developing roller 27, the supply roller 28, and the thickness-regulating blade 29. The developer container 223 is disposed in the developer-accommodating chamber 222 and accommodates toner T. The take-up member 210 is adapted to take up the developer container 223.

The developer container 223 is formed from a single sheet. A first end portion 225 of the sheet providing the developer container 223 is fixed to the take-up member 210, while a second end portion 226 on an opposite end portion of the sheet from the first end portion 225 is folded back to form a folded surface 227. The folded surface 227 is then bonded to an underside surface of a portion of the developer container 223 near the first end portion 225 to form the developer container 223 into a tubular shape. The developer container 223 is filled with toner T before both edges of the tube forming developer container 223 are each bonded so that the toner T is sealed in the developer container 223.

An opening 228 is formed in the casing 221. The first end portion 225 of the developer container 223 is inserted through the opening 228 and wound about the take-up member 210. A restricting portion 229 is provided below the opening 228. When the take-up member 210 is rotated, the developer container 223 is drawn toward the take-up member 210 through the opening 228. At this time, the second end portion 226 of the developer container 223 contacts the restricting portion 229 and is peeled off the folded surface 227, allowing toner T in the developer container 223 to be discharged into the developer-accommodating chamber 222. By peeling apart the edges of the developer container 223 to discharge the toner T, the developer container 223 is returned to a sheet form.

Here, the take-up member 210 constitutes the unsealing mechanism together with the restricting portion 229. Further, the take-up member 210 functions to draw in the developer container 223 opened into a sheet form from the first end portion 225 to the second end portion 226.

Figure 11B:
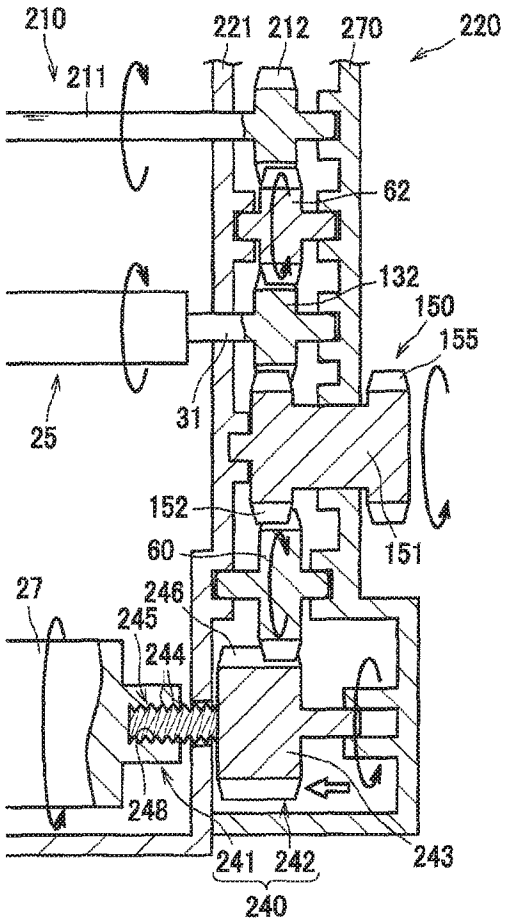
Figure 11A:
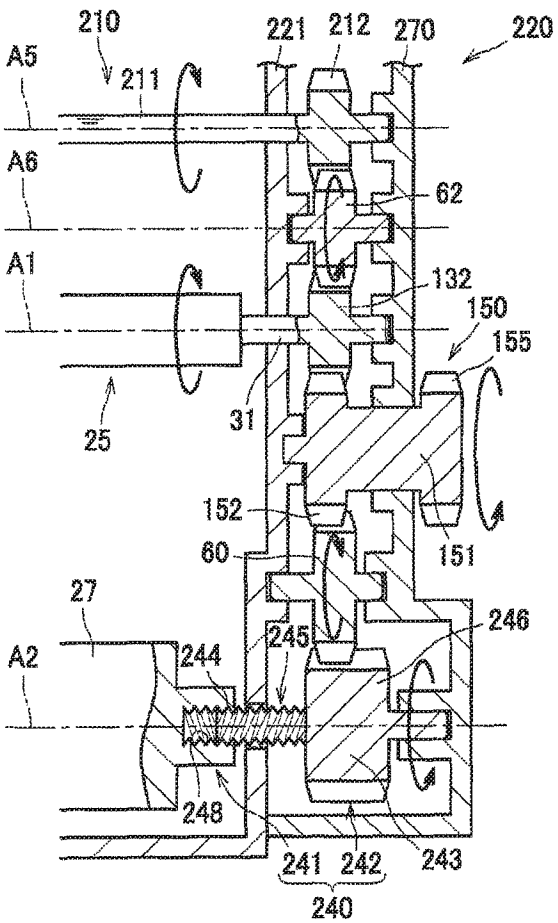

As illustrated in FIG. 11A, the developing cartridge 220 is further provided with a gear cover 270, and the take-up member 210 has a shaft 211. One end portion of the shaft 211 of the take-up member 210 and the one end portion of the shaft 31 of the agitator 25 protrude to an outer side of the casing 221 and are rotatably supported to the gear cover 270. One end portion of the developing roller 27 does not protrude to the outer side of the casing 221 and is positioned inside the casing 221.

The casing 221 and the gear cover 270 also rotatably support a fifth gear 212 serving as the first rotary body, the first gear 132, a second intermediate gear 62, the drive gear 150, the intermediate gear 60, and a second rotary body 240.

The fifth gear 212 is provided at the one end portion of the shaft 211 of the take-up member 210 protruding to the outer side of the casing 221. The fifth gear 212 is capable of rotating about a fifth axis A5 parallel to the first axis A1 of the agitator 25. The second intermediate gear 62 is meshed with the fifth gear 212 and the first gear 132. The second intermediate gear 62 is capable of rotating about a sixth axis A6 parallel to the fifth axis A5. The intermediate gear 60 is adapted to transmit the drive force from the drive gear 150 to the developing roller 27. The second rotary body 240 is provided at the one end portion of the developing roller 27.

The second rotary body 240 has an input-side rotary member 242, and an output-side rotary member 241 capable of rotating coaxially with the input-side rotary member 242.

The input-side rotary member 242 is rotatably supported to the casing 221 and the gear cover 270, and is capable of rotating about the second axis A2 (the rotational axis). The input-side rotary member 242 has a body portion 243, a protruding portion 245, and a slidable gear 246. The protruding portion 245 protrudes toward the casing 221 from the body portion 243. A spiral-shaped ridge 244 (male thread) as an example of an engaging protrusion is formed on a circumferential surface of the protruding portion 245. The slidable gear 246 is provided at the body portion 243 and meshed with the intermediate gear 60.

The output-side rotary member 241 is provided at the one end portion of the developing roller 27 inside the casing 221. The output-side rotary member 241 has an engaging groove 248 (female thread) having a spiral shape that conforms to the spiral-shaped ridge 244 provided at the input-side rotary member 242.

A length and a pitch of each of the spiral-shaped ridge 244 and the engaging groove 248 are set to correspond to a time (the prescribed time) that elapses from a moment rotation of the take-up member 210 is initiated to a moment the developer container 223 is unsealed. Specifically, the length and the pitch of the spiral shapes are set so that the ridge 244 does not reach a bottom end of the engaging groove 248 until the developer container 223 has contacted the restricting portion 229 and opened into a sheet form.

In the developing cartridge 220 of the third embodiment having the above configuration, the delayed transmission mechanism is configured by the second rotary body 240 provided at the one end portion of the developing roller 27, i.e., the input-side rotary member 242 and the output-side rotary member 241. The drive force transmitted to the input-side rotary member 242 is subsequently transmitted to the output-side rotary member 241 after the spiral-shaped ridge 244 has rotated a prescribed distance within the engaging groove 248.

Next, operations of the developing cartridge 220 will be described.

As illustrated in FIGS. 10A and 11A, when an unused developing cartridge 220 is mounted in the main casing 2 of the laser printer 1, the drive force is inputted into the drive gear 150 from the motor M serving as the drive source via the input gear 155, and the drive gear 150 begins to rotate.

Since the fourth gear 152 of the drive gear 150 is meshed with the first gear 132 of the agitator 25, the agitator 25 begins rotating when the drive gear 150 rotates. Similarly, since the fourth gear 152 is meshed with the fifth gear 212 of the take-up member 210 via the second intermediate gear 62 of the first gear 132, the take-up member 210 begins to rotate when the drive gear 150 rotates.

Similarly, since the fourth gear 152 is meshed with the slidable gear 246 of the developing roller 27 via the intermediate gear 60, the slidable gear 246 begins to rotate when the drive gear 150 rotates. While rotating, the slidable gear 246 moves toward the casing 221, i.e. inward in a second axial direction along the second axis A2. However, since the ridge 244 of the input-side rotary member 242 moves along the engaging groove 248 of the output-side rotary member 241, the input-side rotary member 242 rotates freely relative to the output-side rotary member 241. Accordingly, the developing roller 27 remains idle during this time. In other words, the developing roller 27 does not rotate while the ridge 244 of the input-side rotary member 242 moves along the engaging groove 248 of the output-side rotary member 241.

As illustrated in FIGS. 10B and 11B, the developer container 223 is unsealed and opened into a sheet form by the rotation of the take-up member 210. As a result, toner T is discharged into the developer-accommodating chamber 222 and agitated by the blade 25B fixed to the rotary member 25A of the agitator 25.

As the input-side rotary member 242 continues to rotate, the spiral-shaped ridge 244 arrives at the bottom end of the engaging groove 248 formed in the output-side rotary member 241, halting movement of the slidable gear 246 in the second axial direction.

Thereafter, the input-side rotary member 242 and the output-side rotary member 241 rotate together. Hence, the agitator 25, the take-up member 210, and the developing roller 27 rotate together.

With the developing cartridge 220 of the third embodiment having the above configuration, the load applied to the motor M when unsealing the developer container 223 and the load applied to the motor M when initiating rotation of the developing roller 27 can be staggered, thereby preventing the entire load from being applied to the motor M simultaneously. This configuration can ensure stable operation of the developing cartridge 220.

In the developing cartridge 220 according to the third embodiment, the spiral-shaped ridge 244 is provided at the input-side rotary member 242 while the spiral-shaped engaging groove 248 is formed in the output-side rotary member 241. However, a spiral-shaped rib that engages in the engaging groove 248 may be provided at the input-side rotary member 242 in place of the spiral-shaped ridge 244. The spiral-shaped rib may be formed such that the rib protrudes radially outward from the circumferential surface of the protruding portion 245 and extends in the second axial direction. Alternatively, an engaging groove may be formed in the input-side rotary member, while a spiral-shaped ridge or a spiral-shaped rib may be provided at the output-side rotary member.

In the developing cartridge 220 according to the third embodiment, rotation of the developing roller 27 is initiated after the developer container 223 has been unsealed and opened into a sheet form. However, by reducing the pitch for the spiral-shaped ridge 244 of the input-side rotary member 242 and the engaging groove 248 of the output-side rotary member 241 while increasing the length of their spiral shapes, for example, rotation of the developing roller 27 may be initiated after the take-up member 210 has taken up the entire developer container 223 opened into a sheet form.

This arrangement can further reduce the load applied to the motor M when rotation of the developing roller 27 begins.

<Fourth Embodiment>

Next, a developing cartridge 320 according to a fourth embodiment will be described with reference to FIGS. 12A through 14B, wherein like parts and components with those of the developing cartridge 120 according to the second embodiment and the developing cartridge 220 of the third embodiment are designated with the same reference numerals to avoid duplicating description.

In the developing cartridge 320 according to the fourth embodiment, the developing roller 27 is provided with a one-way clutch 340 described later. Under control of the control device 100 in the laser printer 1, the motor M is driven to rotate both forward and in reverse in order to distribute the load applied to the motor M at a timing at which the developer container is unsealed and the load applied to the motor M at a timing at which rotation of the developing roller 27 begins.

Figure 12B:
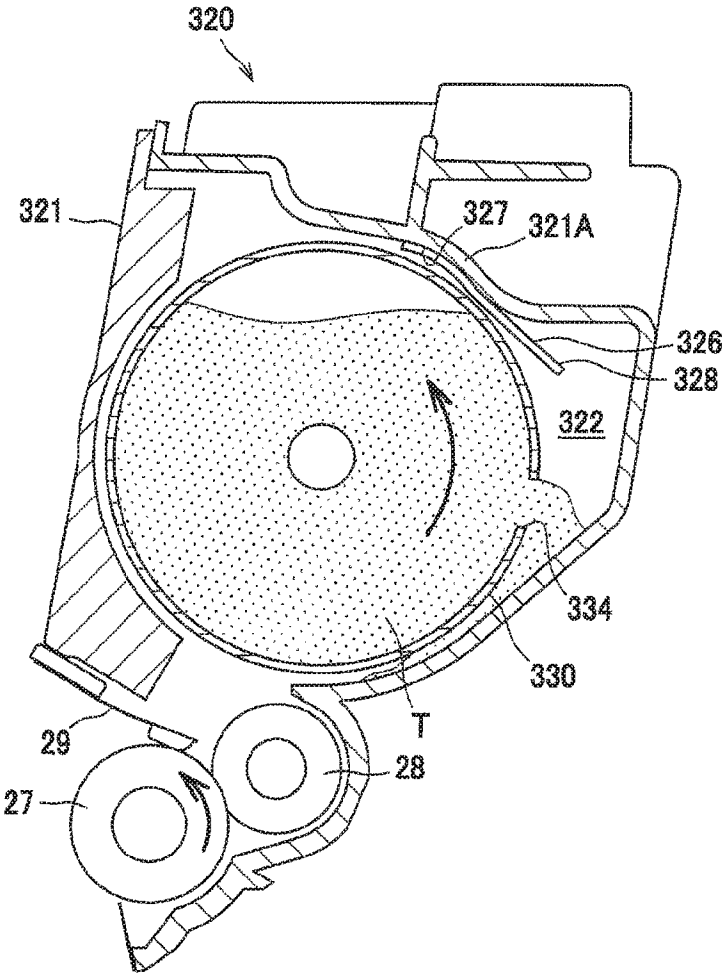
FIG. 12B is a cross-sectional view of the developing cartridge according to the fourth embodiment in a state where the developer container rotates forward together with a developing roller after the developer container has been unsealed.
Figure 12A:
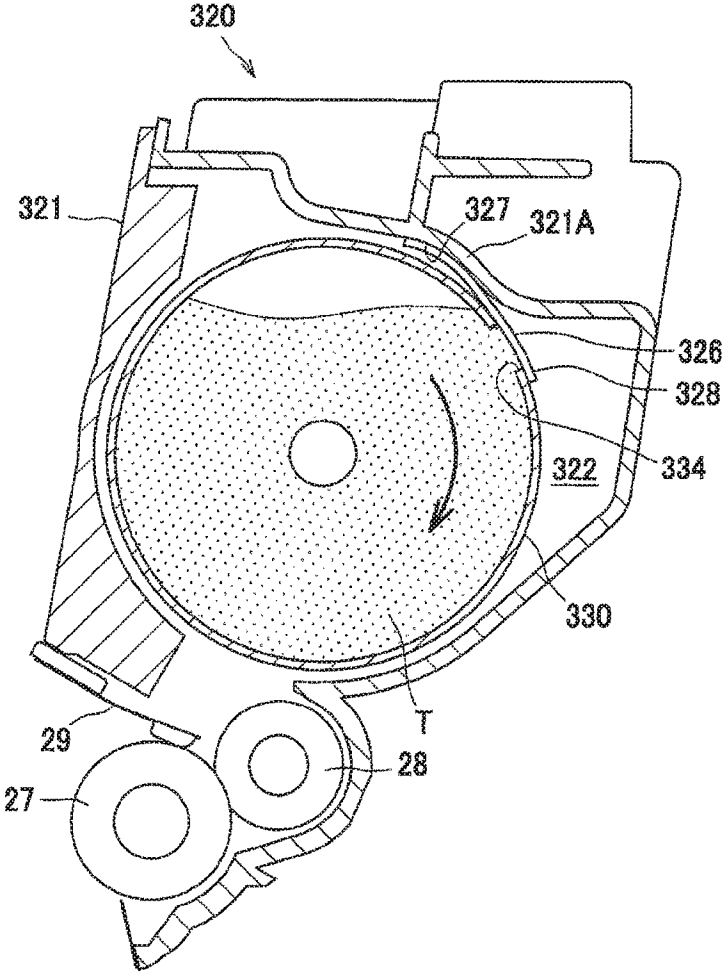
FIG. 12A is a cross-sectional view of a developing cartridge according to a fourth embodiment in a state where the developing cartridge is unused and a developer container thereof has begun to rotate in reverse.

As illustrated in FIGS. 12A and 12B, the developing cartridge 320 is provided with a casing 321, and a developer-accommodating chamber 322 formed inside the casing 321. The developing cartridge 320 is further provided with a developer container 330, a sheet-like sealing member 326, the developing roller 27, the supply roller 28, and the thickness-regulating blade 29. The developer container 330 is disposed in the developer-accommodating chamber 322 and accommodates toner T. The sealing member 326 seals an outlet 334 formed in the developer container 330.

The developer container 330 is rotatably supported to the casing 321. Together with the sealing member 326, the developer container 330 constitutes the unsealing mechanism. The developer container 330 has a cylindrical shape and may be formed of the same resin material used for forming the casing 321, for example.

Figure 13A:
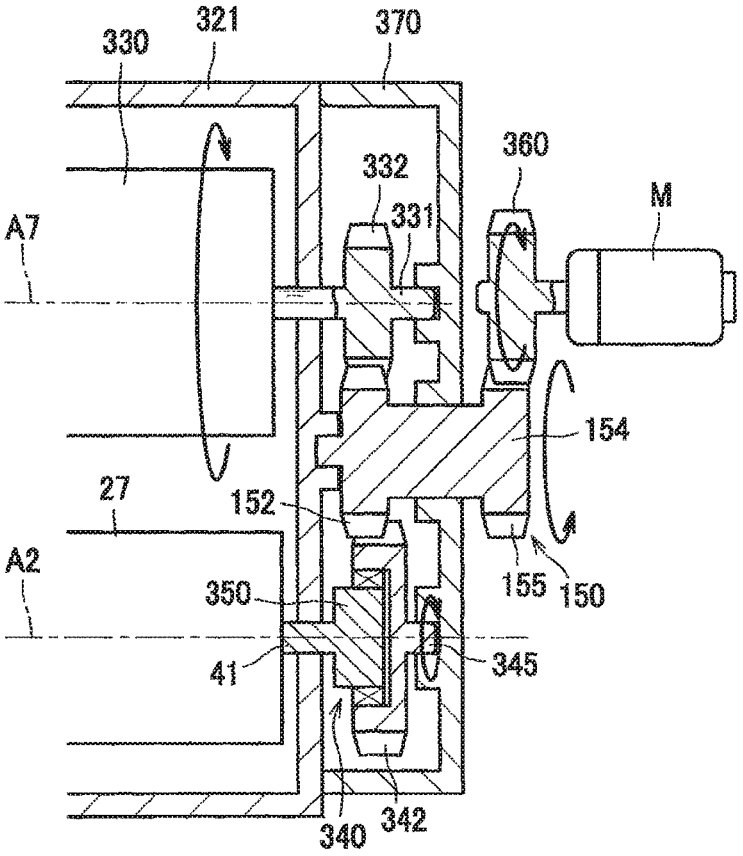

As illustrated in FIG. 13A, the developer container 330 has a shaft 331 capable of rotating about a seventh axis A7 parallel to the second axis A2 of the developing roller 27. The developing cartridge 320 is also provided with a gear cover 370. One end portion of the shaft 331 protrudes to an outer side of the casing 321 and is rotatably supported to the gear cover 370. A sixth gear 332 serving as the first rotary body is provided at the one end portion of the shaft 331 of the developer container 330 protruding to the outer side of the casing 321.

As illustrated in FIG. 12A, a first end portion 327 of the sealing member 326 is fixed to a top wall 321A of the casing 321, and a second end portion 328 is releasably bonded to a peripheral surface around the outlet 334 formed in the developer container 330. The sealing member 326 is formed of polyethylene terephthalate (PET), polyethylene (PE), or polypropylene (PP), for example.

As illustrated in FIG. 13A, the casing 321 and the gear cover 370 rotatably support the drive gear 150. The drive gear 150 is disposed between the sixth gear 332 of the developer container 330 and the one-way clutch 340 of the developing roller 27 described later.

The one end portion of the shaft 41 of the developing roller 27 protrudes to the outer side of the casing 321 and is rotatably supported to the gear cover 370. The one-way clutch 340 serving as the second rotary body is provided at the one end portion of the shaft 41 protruding to the outer side of the casing 321.

The one-way clutch 340 has an input-side rotary member 345, and an output-side rotary member 350 capable of rotating coaxially with the input-side rotary member 345. The input-side rotary member 345 serves as an outer race and is rotatably supported to the gear cover 370. The output-side rotary member 350 serves as an inner race and is capable of transmitting rotation of the input-side rotary member 345 for only one direction.

The input-side rotary member 345 has an input gear 342 arranged on its outer circumferential surface, and an inner circumferential surface 344. The input gear 342 meshes with the fourth gear 152 of the drive gear 150. The output-side rotary member 350 is allowed to rotate unidirectionally along the inner circumferential surface 344. When the motor M is driven to rotate in reverse, the input-side rotary member 345 rotates in a direction indicated by an arrow in FIG. 13B (i.e. reverse direction). When the motor M is driven to rotate forward, the input-side rotary member 345 rotates in a direction indicated by an arrow in FIG. 14B (i.e. forward direction).

The output-side rotary member 350 is fitted into the input-side rotary member 345. The output-side rotary member 350 is adapted to interrupt transmission of rotation of the input-side rotary member 345 in the reverse direction and to transmit rotation of the input-side rotary member 345 in the forward direction. In other words, the output-side rotary member 350 is configured so as not to rotate when the input-side rotary member 345 rotates in the reverse direction and to rotate in the forward direction when the input-side rotary member 345 rotates in the forward direction.

Specifically, the output-side rotary member 350 has grooves 352 formed in an outer circumferential surface thereof at two diametrically opposing positions. The grooves 352 extend along a circumferential direction of the output-side rotary member 350. Based on the reverse rotating direction of the input-side rotary member 345, each groove 352 has a downstream end 354 positioned on a downstream side in the groove 352 in the reverse direction, and an upstream end 356 positioned on a upstream side in the groove 352 in the reverse direction. The groove 352 has a depth that is greater at the downstream end 354 than the upstream end 356 and grows gradually shallower from the downstream end 354 toward the upstream end 356. A spring 357 and a roller 358 are disposed in each groove 352. One end of the spring 357 is fixed to the downstream end 354 of the corresponding groove 352, while the other end of the spring 357 supports and urges the roller 358 toward the upstream end 356.

Two sets of the groove 352, the spring 357, and the roller 358 serve as a clutch portion. The input-side rotary member 345, the output-side rotary member 350, and the clutch portion constitute the one-way clutch 340.

Figure 13B:
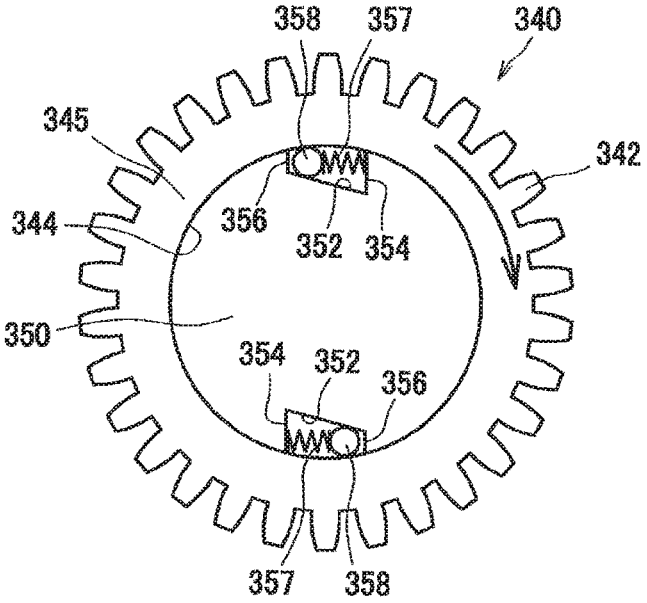

With the one-way clutch 340 having the above configuration, when the input-side rotary member 345 rotates in the reverse direction illustrated in FIG. 13B, each roller 358 can rotate within a space defined by the inner circumferential surface 344 of the input-side rotary member 345 and the corresponding groove 352 formed in the output-side rotary member 350. Accordingly, the input-side rotary member 345 rotates freely relative to the output-side rotary member 350. Hence, transmission of the drive force from the input-side rotary member 345 to the output-side rotary member 350 is interrupted.

Figure 14A:
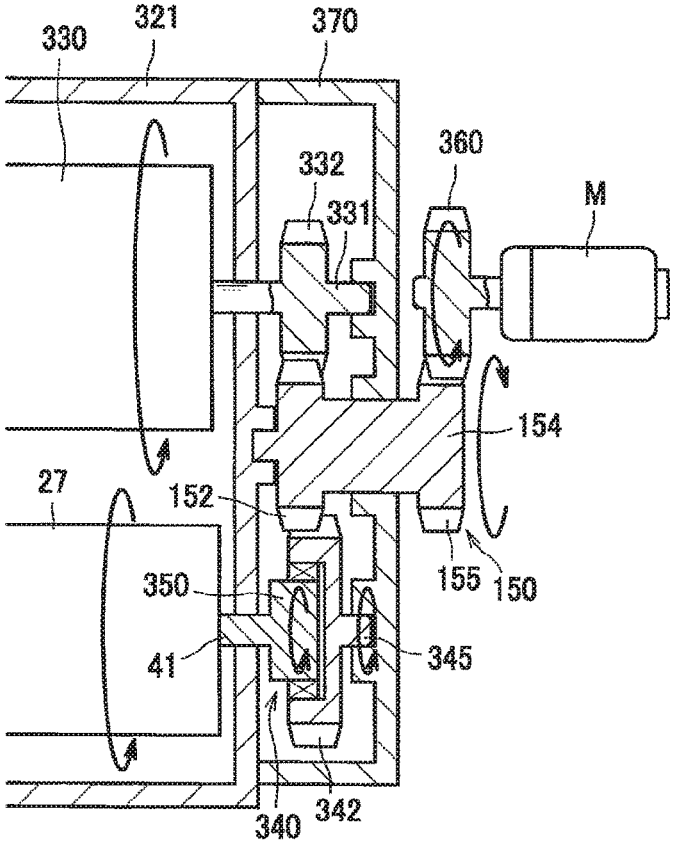
Figure 14B:
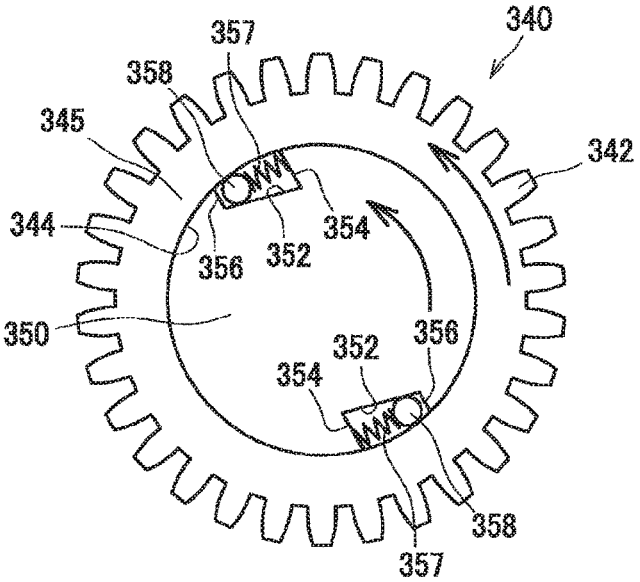

However, when the input-side rotary member 345 rotates in the forward direction illustrated in FIG. 14B, each roller 358 becomes nipped by the inner circumferential surface 344 of the input-side rotary member 345 and the corresponding groove 352 formed in the output-side rotary member 350. A frictional force produced by the nipped rollers 358 forces the output-side rotary member 350 to rotate in the forward direction together with the input-side rotary member 345.

In the developing cartridge 320 according to the fourth embodiment having the above configuration, the delayed transmission mechanism is configured by the one-way clutch 340 provided at the one end portion of the developing roller 27 protruding to the outer side of the casing 321 and serving as the second rotary body.

Next, operations of the developing cartridge 320 will be described.

When the control device 100 detects that an unused developing cartridge 320 has been mounted in the main casing 2 of the laser printer 1, the control device 100 drives the motor M to rotate in reverse (i.e., in a rotating direction for rotating a drive input gear 360 in a direction indicated by an arrow in FIG. 13A).

At this time, the drive force from the motor M serving as the drive source is inputted into the drive gear 150 via the drive input gear 360 meshed with the input gear 155, as illustrated in FIG. 13A. Accordingly, the drive gear 150 begins rotating in the forward direction. Note that the drive input gear 360 is provided at the main casing 2 and coupled with the motor M.

Since the fourth gear 152 of the drive gear 150 is meshed with the sixth gear 332 provided at the shaft 331 of the developer container 330 and the input gear 342 of the input-side rotary member 345 of the developing roller 27, the developer container 330 and the input gear 342 begin rotating in the reverse direction when the drive gear 150 rotates forward. However, since the rotation of the input-side rotary member 345 is not transmitted to the output-side rotary member 350, the developing roller 27 remains idle. That is, the developing roller 27 does not rotate.

When the developer container 330 rotates in the reverse direction, as illustrated in FIG. 12A, the sealing member 326 is peeled off the developer container 330, thereby unsealing the developer container 330.

After the prescribed time required for unsealing the developer container 330 has elapsed, the control device 100 then drives the motor M to rotate forward (i.e., in a rotating direction for rotating the drive input gear 360 in a direction indicated by an arrow in FIG. 14A).

At this time, the drive force inputted from the motor M rotates the drive gear 150 in the reverse direction, as illustrated in FIG. 14A, thereby rotating the developer container 330 and the input gear 342 in the forward direction. Further, since the rotation of the input-side rotary member 345 is transmitted to the output-side rotary member 350 at this time, the drive force transmitted to the one-way clutch 340 from the drive gear 150 rotates the developing roller 27 in the forward direction.

When the developer container 330 is rotated in the forward direction, as illustrated in FIG. 12B, toner T in the developer container 330 is discharged through the unsealed outlet 334 into the developer-accommodating chamber 322.

Thereafter, both the developer container 330 and the developing roller 27 continue to rotate in the forward direction.

With the developing cartridge 320 of the fourth embodiment having the above configuration, the load applied to the motor M when unsealing the developer container 330 and the load applied to the motor M when initiating rotation of the developing roller 27 can be staggered, thereby preventing the entire load from being applied to the motor M simultaneously. This configuration can ensure stable operation of the developing cartridge 320.

In the developing cartridge 320 according to the fourth embodiment, the drive force from the motor M serving as the drive source is transmitted to the developing roller 27 via the drive gear 150 provided in the developing cartridge 320 and the one-way clutch 340 serving as the second rotary body provided at the developing roller 27. The developing cartridge may also be configured without the drive gear 150, as in the modifications described below. Further, the transmission route for transmitting the drive force from the drive source to the developing roller 27 via the one-way clutch may be modified in various ways.

In the following modifications, the delayed transmission mechanism is configured by a one-way clutch, and the unsealing mechanism is configured similarly to the developing cartridge 320 according to the fourth embodiment.

<First Modification>

A developing cartridge 420 according to a first modification will be described with reference to FIGS. 15A and 15B, wherein like parts and components with those of the developing cartridge 320 according to the fourth embodiment are designated with the same reference numerals to avoid duplicating description.

In this modification, the developing cartridge 420 is not provided with a drive gear. Instead, a drive force from the motor M serving as the drive source provided in the main casing 2 of the laser printer 1 is inputted into the first rotary body 332 through the drive input gear 360.

Further, in this modification, the input-side rotary member 345 rotates in reverse when the motor M rotates forward. When the motor M rotates in reverse, the input-side rotary member 345 rotates forward.

Figure 15B:
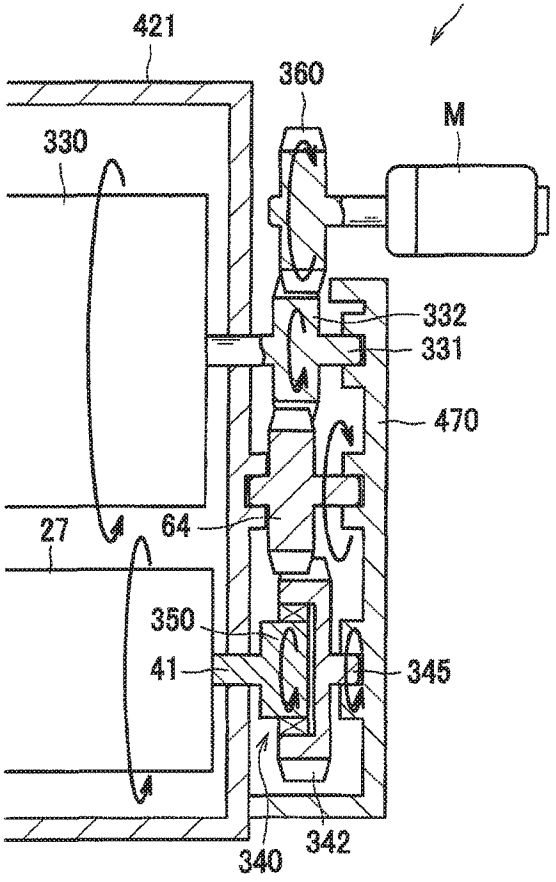
Figure 15A:
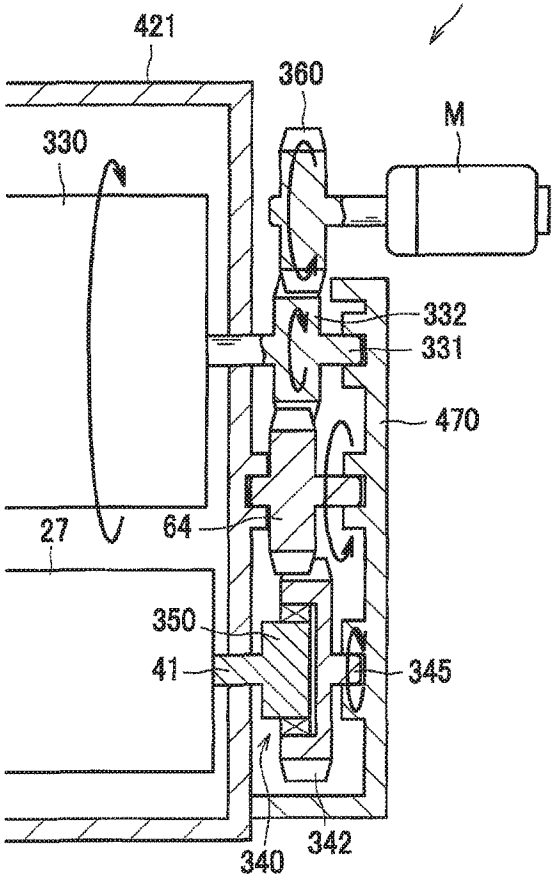

More specifically, as illustrated in FIGS. 15A and 15B, the developing cartridge 420 is provided with a casing 421, and a gear cover 470. The one end portion of the shaft 331 of the developer container 330 and the one end portion of the shaft 41 of the developing roller 27 protrude to an outer side of the casing 421 and are rotatably supported to the gear cover 470.

In addition, a third intermediate gear 64 is provided at a position between the sixth gear 332 and the one-way clutch 340. The sixth gear 332 is provided at the one end portion of the shaft 331 protruding to the outer side of the casing 421 and serves as the first rotary body. The one-way clutch 340 is provided at the one end portion of the shaft 41 protruding to the outer side of the casing 421 and serves as the second rotary body.

Next, operations of the developing cartridge 420 having the above configuration will be described.

When the control device 100 detects that an unused developing cartridge 420 has been mounted in the main casing 2 of the laser printer 1, the control device 100 drives the motor M to rotate forward (i.e., in a rotating direction for rotating the drive input gear 360 in a direction indicated by an arrow in FIG. 15A).

At this time, the drive force from the motor M is inputted into the sixth gear 332 of the developer container 330 via the drive input gear 360, and accordingly, the developer container 330 begins rotating in the reverse direction, as illustrated in FIG. 15A.

Since the sixth gear 332 of the developer container 330 is meshed with the input gear 342 of the input-side rotary member 345 of the one-way clutch 340 via the third intermediate gear 64, the third intermediate gear 64 begins rotating in the forward direction and the input-side rotary member 345 begin rotating in the reverse direction when the sixth gear 332 rotates in the reverse direction. However, since the rotation of the input-side rotary member 345 is not transmitted to the output-side rotary member 350, the developing roller 27 remains idle. That is, the developing roller 27 does not rotate.

When the developer container 330 rotates in the reverse direction, the sealing member 326 is peeled off the developer container 330, thereby unsealing the developer container 330.

After the prescribed time required for unsealing the developer container 330 has elapsed, the control device 100 then drives the motor M to rotate in reverse (i.e., in a rotating direction for rotating the drive input gear 360 in a direction indicated by an arrow in FIG. 15B). At this time, the drive force from the motor M is inputted into the sixth gear 332 of the developer container 330 via the drive input gear 360, and accordingly, the developer container 330 begins rotating in the forward direction, as illustrated in FIG. 15B. The drive force is further inputted into the input-side rotary member 345 of the one-way clutch 340 via the third intermediate gear 64 and the input gear 342. Since the input-side rotary member 345 of the one-way clutch 340 rotates in the forward direction and the drive force is transmitted to the output-side rotary member 350 of the one-way clutch 340 from the input-side rotary member 345 of the one-way clutch 340 at this time, the developing roller 27 begins rotating in the forward direction.

When the developer container 330 rotates in the forward direction, toner T accommodated in the developer container 330 is discharged through the unsealed outlet 334 into the developer-accommodating chamber 322.

Thereafter, both the developer container 330 and the developing roller 27 continue to rotate in the forward direction.

<Second Modification>

A developing cartridge 520 according to a second modification will be described with reference to FIGS. 16A and 16B, wherein like parts and components with those of the developing cartridge 320 according to the fourth embodiment are designated with the same reference numerals to avoid duplicating description.

The developing cartridge 520 has a one-way clutch provided at one end portion of the developer container 330.

Figure 16B:
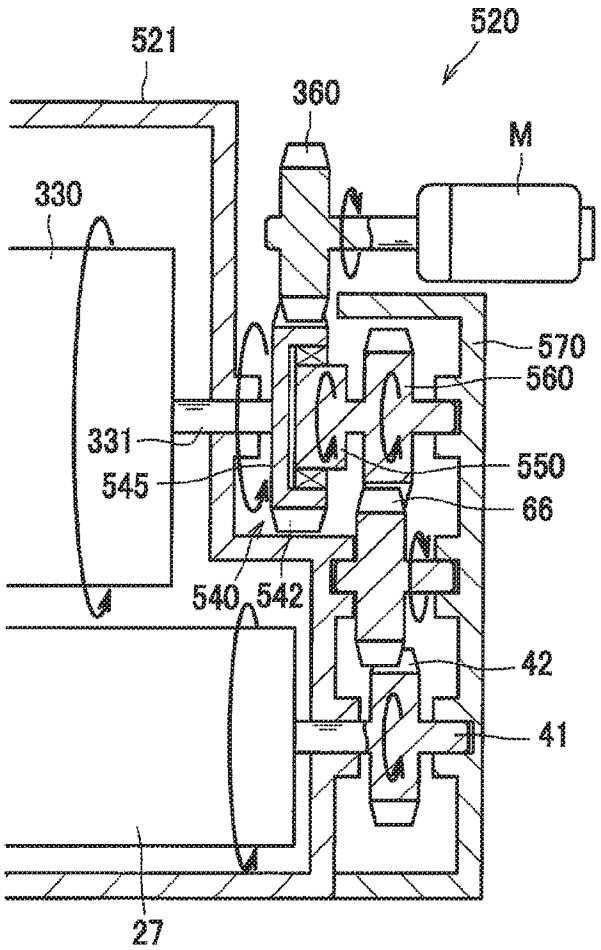
Figure 16A:
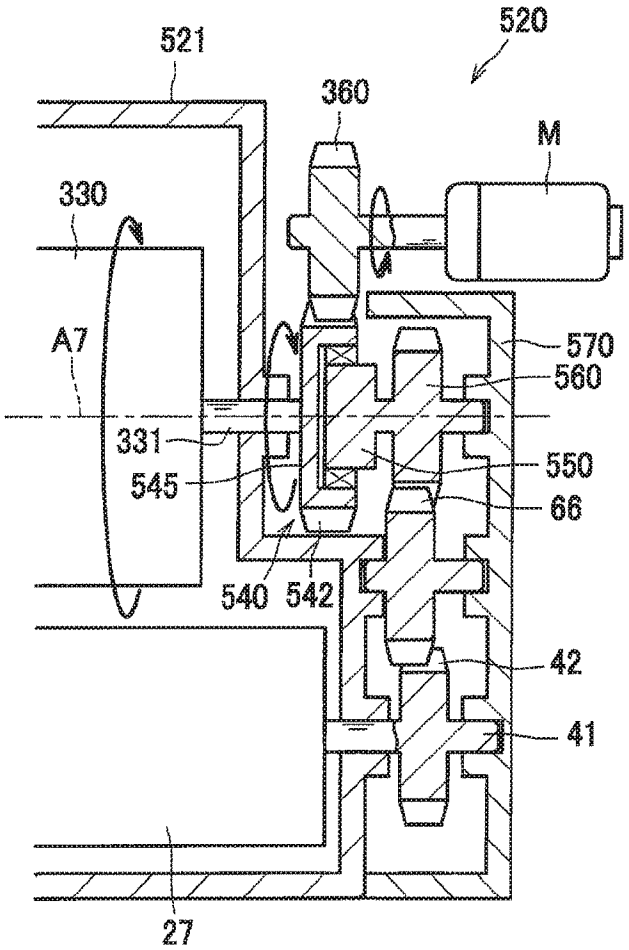

As illustrated in FIGS. 16A and 16B, the developing cartridge 520 is provided with a casing 521, and a gear cover 570. The one end portion of the shaft 331 of the developer container 330 and the one end portion of the shaft 41 of the developing roller 27 protrude to an outer side of the casing 521 and are rotatably supported to the gear cover 570.

A one-way clutch 540 serving as the first rotary body and an output gear 560 are provided at the one end portion of the shaft 331 protruding to the outer side of the casing 321.

The one-way clutch 540 has an input-side rotary member 545 serving as an outer race, an output-side rotary member 550 serving as an inner race, and a clutch portion (not illustrated) similar to the clutch portion of the one-way clutch 340.

The input-side rotary member 545 has an input gear 542 arranged on its outer circumferential surface. The input gear 542 meshes with the drive input gear 360. The input-side rotary member 545 rotates in reverse when the motor M rotates forward (i.e., in a rotating direction for rotating the drive input gear 360 in a direction indicated by an arrow in FIG. 16A). When the motor M rotates in reverse (i.e., in a rotating direction for rotating the drive input gear 360 in a direction indicated by an arrow in FIG. 16B), the input-side rotary member 545 rotates forward.

The output-side rotary member 550 is fitted into the input-side rotary member 545. The output-side rotary member 550 is adapted to interrupt transmission of rotation of the input-side rotary member 545 in the reverse direction and to transmit rotation of the input-side rotary member 545 in the forward direction. In other words, the output-side rotary member 550 is configured so as not to rotate when the input-side rotary member 545 rotates in the reverse direction and to rotate in the forward direction when the input-side rotary member 545 rotates in the forward direction, as in the fourth embodiment.

The shaft 331 of the developer container 330 is coupled with the input-side rotary member 545.

The output gear 560 is a gear capable of rotating about the seventh axis A7. The output gear 560 is provided at an outer side of the one-way clutch 540 in a third axial direction along the seventh axis A7. In other words, the output gear 560 is disposed opposite to the casing 521 with respect to the one-way clutch 540 in the third axial direction.

The output gear 560 is provided at the output-side rotary member 550 of the one-way clutch 540.

The casing 521 and the gear cover 570 rotatably support a fourth intermediate gear 66. The fourth intermediate gear 66 is disposed between the output gear 560 provided at the one end portion of the developer container 330 and the third gear 42 provided at the one end portion of the shaft 41 of the developing roller 27. The third gear 42 serves as the second rotary body.

Next, operations of the developing cartridge 520 having the above configuration will be described.

When the control device 100 detects that an unused developing cartridge 520 has been mounted in the main casing 2 of the laser printer 1, the control device 100 drives the motor M to rotate forward.

At this time, the drive force from the motor M serving as the drive source is inputted into the input-side rotary member 545 of the one-way clutch 540 coupled to the developer container 330 via the drive input gear 360. Accordingly, the developer container 330 begins rotating in the reverse direction, as illustrated in FIG. 16A.

However, since the rotation of the input-side rotary member 545 is not transmitted to the output-side rotary member 550, transmission of the drive force to the output gear 560 remains interrupted and, hence, the fourth intermediate gear 66 and the third gear 42 do not rotate. Accordingly, the developing roller 27 remains idle. That is, the developing roller 27 does not rotate.

When the developer container 330 rotates in the reverse direction, the sealing member 326 is peeled off the developer container 330, thereby unsealing the developer container 330.

After the prescribed time required for unsealing the developer container 330 has elapsed, the control device 100 then drives the motor M to rotate in reverse. Since the drive force from the motor M is inputted into the input-side rotary member 545 of the one-way clutch 540 through the drive input gear 360 at this time, the developer container 330 begins rotating in the forward direction, as illustrated in FIG. 16B. Further, since the drive force is transmitted from the input-side rotary member 545 to the output-side rotary member 550, the drive force is further transmitted to the third gear 42 via the output gear 560 and the fourth intermediate gear 66. Accordingly, the developing roller 27 begins rotating in the forward direction.

When the developer container 330 rotates in the forward direction, toner T accommodated in the developer container 330 is discharged through the unsealed outlet 334 into the developer-accommodating chamber 322.

Thereafter, both the developer container 330 and the developing roller 27 continue to rotate in the forward direction.

With the developing cartridge 420 according to the first variation and the developing cartridge 520 according to the second variation, the load applied to the motor M can be distributed between a timing at which the developer container 330 is unsealed and a timing at which rotation of the developing roller 27 is initiated, thereby preventing the entire load from being applied to the motor M simultaneously. Accordingly, the developing cartridge 420 and the developing cartridge 520 can operate stably.

While the present disclosure was applied to a developing cartridge in the embodiments and modifications described above, the present disclosure may also be applied to a process cartridge integrally configured of a developing cartridge and a drum unit, for example.

While the description has been made in detail with reference to the embodiments thereof, it would be apparent to those skilled in the art that many modifications and variations may be made therein without departing from the scope of the disclosure.

What is claimed is:

1. A developing cartridge comprising:

a casing;

a developer container provided in the casing, the developer container being configured to be sealed to accommodate developer;

a developing roller rotatably supported to the casing and having a rotation shaft;

an unsealing mechanism rotatably supported to the casing and having a rotation shaft, the unsealing mechanism being configured to unseal the developer container;

a first rotary body provided at one end portion of the rotation shaft of the unsealing mechanism;

a second rotary body, a drive force generated by a drive source being transmitted to the first rotary body and the second rotary body, the second rotary body being configured to transmit the drive force from the drive source to the rotation shaft of the developing roller; and a delayed transmission mechanism delaying transmission of the drive force from the drive source to the second rotary body for at least a prescribed time after transmission of the drive force from the drive source to the first rotary body is initiated, the prescribed time being equivalent to a time that elapses from a moment the unsealing mechanism begins rotating to a moment the unsealing mechanism has unsealed the developer container, wherein the delayed transmission mechanism includes a transmission rotary body configured to transmit the drive force generated by the drive source to the first rotary body and the second rotary body, the transmission rotary body initiating transmission of the drive force from the drive source to the second rotary body when the prescribed time has elapsed after the transmission rotary body initiates transmission of the drive force from the drive source to the first rotary body, wherein the transmission rotary body is configured to move from a first position in which the transmission rotary body meshes with the first rotary body and does not mesh with the second rotary body to a second position in which the transmission rotary body meshes with both the first rotary body and the second rotary body, wherein the prescribed time is required for the transmission rotary body to be moved from the first position to the second position wherein the first rotary body comprises:

a first gear capable of rotating about a first axis extending in a first axial direction;

a second gear capable of rotating coaxially with the first gear, the second gear being disposed at an outer side of the first gear in the first axial direction; and a flange capable of rotating together with the second gear and disposed between the first gear and the second gear, the flange having a diameter greater than a diameter of an addendum circle of the second gear, the flange having a notch, wherein the second rotary body comprises a third gear capable of rotating about a second axis parallel to the first axis, and wherein the transmission rotary body comprises a transmission gear, the transmission gear meshing with the second gear when the transmission rotary body is at the first position and meshing with the first gear and the third gear when the transmission rotary body is at the second position, the developing cartridge further comprising an urging member urging the transmission gear inward in the first axial direction, wherein the transmission gear is supported by the flange until the prescribed time has elapsed after rotation of the transmission gear is initiated, the transmission gear moving inward in the first axial direction to mesh with the second gear and the third gear when the transmission gear confronts the notch.

2. The developing cartridge according to claim 1, wherein the second gear rotates a first angle in the prescribed time after the second gear begins to rotate, and wherein the flange has a second angle in a rotating direction of the flange, the first angle being smaller than the second angle.

3. The developing cartridge according to claim 2, wherein the flange has a first edge and a second edge opposite to the first edge in the rotating direction, the first edge and the second edge defining the notch, wherein the second angle is an angle of the flange formed by a first line segment connecting the first axis and the first edge and a second line segment connecting the first axis and the second edge, and wherein the second angle is in a range from 90 degrees to 315 degrees.

4. The developing cartridge according to claim 3, wherein the second angle is in a range from 180 degrees to 270 degrees.

5. A developing cartridge comprising:

a casing;

a developer container provided in the casing, the developer container being configured to be sealed to accommodate developer;

a developing roller rotatably supported to the casing and having a rotation shaft;

an unsealing mechanism rotatably supported to the casing and having a rotation shaft, the unsealing mechanism being configured to unseal the developer container;

a first rotary body provided at one end portion of the rotation shaft of the unsealing mechanism;

a second rotary body, a drive force generated by a drive source being transmitted to the first rotary body and the second rotary body, the second rotary body being configured to transmit the drive force from the drive source to the rotation shaft of the developing roller; and a delayed transmission mechanism delaying transmission of the drive force from the drive source to the second rotary body for at least a prescribed time after transmission of the drive force from the drive source to the first rotary body is initiated, the prescribed time being equivalent to a time that elapses from a moment the unsealing mechanism begins rotating to a moment the unsealing mechanism has unsealed the developer container, wherein one of the first rotary body and the second rotary body comprises:

an input-side rotary member; and an output-side rotary member capable of rotating coaxially with the input-side rotary member, the output-side rotary member engaging with the input-side rotary member such that the drive force transmitted to the input-side rotary member is transmitted to the output-side rotary member after the input-side rotary member has rotated a prescribed amount, and wherein the delayed transmission mechanism comprises the input-side rotary member and the output-side rotary member.

6. The developing cartridge according to claim 5, wherein one of the input-side rotary member and the output-side rotary member has a rotation axis and an engaging groove having an arcuate shape centered on the rotational axis, and wherein the other of the input-side rotary member and the output-side rotary member has an engaging protrusion engaged with the engaging groove.

7. The developing cartridge according to claim 5, wherein one of the input-side rotary member and the output-side rotary member has an engaging groove having a spiral shape, and wherein the other of the input-side rotary member and the output-side rotary member has an engaging protrusion engaged with the engaging groove.

8. A developing cartridge comprising:

a casing;

a developer container provided in the casing, the developer container being configured to be sealed to accommodate developer;

a developing roller rotatably supported to the casing and having a rotation shaft;

an unsealing mechanism rotatably supported to the casing and having a rotation shaft, the unsealing mechanism being configured to unseal the developer container;

a first rotary body provided at one end portion of the rotation shaft of the unsealing mechanism;

a second rotary body, a drive force generated by a drive source being transmitted to the first rotary body and the second rotary body, the second rotary body being configured to transmit the drive force from the drive source to the rotation shaft of the developing roller; and a delayed transmission mechanism delaying transmission of the drive force from the drive source to the second rotary body for at least a prescribed time after transmission of the drive force from the drive source to the first rotary body is initiated, the prescribed time being equivalent to a time that elapses from a moment the unsealing mechanism begins rotating to a moment the unsealing mechanism has unsealed the developer container, wherein the second rotary body comprises a one-way clutch including:

an input-side rotary member into which the drive force from the drive source is inputted;

an output-side rotary member coupled with the developing roller; and a clutch portion configured:

to transmit the drive force inputted into the input-side rotary member to the output-side rotary member when the drive force inputted into the input-side rotary member rotates the input-side rotary member in a first direction; and to interrupt transmission of the drive force inputted into the input-side rotary member to the output-side rotary member when the drive force inputted into the input-side rotary member rotates the input-side rotary member in a second direction opposite to the first direction, and wherein the delayed transmission mechanism comprises the one-way clutch.

9. A developing cartridge comprising:

a casing;

a developer container provided in the casing, the developer container being configured to be sealed to accommodate developer;

a developing roller rotatably supported to the casing and having a rotation shaft;

an unsealing mechanism rotatably supported to the casing and having a rotation shaft, the unsealing mechanism being configured to unseal the developer container;

a first rotary body provided at one end portion of the rotation shaft of the unsealing mechanism;

a second rotary body, a drive force generated by a drive source being transmitted to the first rotary body and the second rotary body, the second rotary body being configured to transmit the drive force from the drive source to the rotation shaft of the developing roller; and a delayed transmission mechanism delaying transmission of the drive force from the drive source to the second rotary body for at least a prescribed time after transmission of the drive force from the drive source to the first rotary body is initiated, the prescribed time being equivalent to a time that elapses from a moment the unsealing mechanism begins rotating to a moment the unsealing mechanism has unsealed the developer container, wherein the first rotary body comprises a one-way clutch including:

an input-side rotary member into which the drive force from the drive source is inputted;

an output-side rotary member coupled with the second rotary body so as to be capable of transmitting the drive force to the second rotary body; and a clutch portion configured:

to transmit the drive force inputted into the input-side rotary member to the output-side rotary member when the drive force inputted into the input-side rotary member rotates the input-side rotary member in a first direction; and to interrupt transmission of the drive force inputted into the input-side rotary member to the output-side rotary member when the drive force inputted into the input-side rotary member rotates the input-side rotary member in a second direction opposite to the first direction, wherein the drive source is coupled with the input-side rotary member so as to be capable of transmitting the drive force to the input-side rotary member, and wherein the delayed transmission mechanism comprises the one-way clutch.

10. A developing cartridge comprising:

a casing;

a developer container provided in the casing, the developer container being configured to be sealed to accommodate developer;

a developing roller rotatably supported to the casing and having a rotation shaft;

an unsealing mechanism rotatably supported to the casing and having a rotation shaft, the unsealing mechanism being configured to unseal the developer container;

a first rotary body provided at one end portion of the rotation shaft of the unsealing mechanism;

a second rotary body, a drive force generated by a drive source being transmitted to the first rotary body and the second rotary body, the second rotary body being configured to transmit the drive force from the drive source to the rotation shaft of the developing roller; and a delayed transmission mechanism delaying transmission of the drive force from the drive source to the second rotary body for at least a prescribed time after transmission of the drive force from the drive source to the first rotary body is initiated, the prescribed time being equivalent to a time that elapses from a moment the unsealing mechanism begins rotating to a moment the unsealing mechanism has unsealed the developer container, wherein the delayed transmission mechanism includes a transmission rotary body configured to transmit the drive force generated by the drive source to the first rotary body and the second rotary body, the transmission rotary body initiating transmission of the drive force from the drive source to the second rotary body when the prescribed time has elapsed after the transmission rotary body initiates transmission of the drive force from the drive source to the first rotary body, wherein the first rotary body, the second rotary body, and the transmission rotary body are disposed outside the casing, wherein the transmission rotary body is configured to move from a first position in which the transmission rotary body meshes with the first rotary body and does not mesh with the second rotary body to a second position in which the transmission rotary body meshes with both the first rotary body and the second rotary body, wherein the transmission rotary body at the second position is closer to the casing than the transmission rotary body at the first position is to the casing, wherein the first rotary body comprises:

a first gear capable of rotating about a first axis extending in a first axial direction;

a second gear capable of rotating coaxially with the first gear, the second gear being positioned farther from the casing than the first gear is from the casing in the first axial direction; and a flange capable of rotating together with the second gear and disposed between the first gear and the second gear in the first axial direction, the flange having a diameter greater than a diameter of an addendum circle of the second gear, the flange having a notch, wherein the second rotary body comprises a third gear capable of rotating about a second axis parallel to the first axis, and wherein the transmission rotary body comprises a transmission gear, the transmission gear meshing with the second gear when the transmission rotary body is at the first position and meshing with the first gear and the third gear when the transmission rotary body is at the second position, the developing cartridge further comprising an urging member urging the transmission gear toward the casing in the first axial direction, wherein the transmission gear is supported by the flange and meshes with the first gear until the prescribed time has elapsed after rotation of the transmission gear is initiated, the transmission gear moving toward the casing in the first axial direction to be unmeshed from the first gear and to mesh with the second gear and the third gear when the transmission gear confronts the notch as a result of rotation of the first rotary body.

* * * * *